US007476447B2

(12) United States Patent
Thomas

(10) Patent No.: US 7,476,447 B2
(45) Date of Patent: Jan. 13, 2009

(54) ELASTOMERIC MATERIALS

(75) Inventor: Oomman P. Thomas, Alpharetta, GA (US)

(73) Assignee: Kimberly-Clark Worldwide, Inc.

( * ) Notice: Subject to any disclaimer, the term of this patent is extended or adjusted under 35 U.S.C. 154(b) by 866 days.

(21) Appl. No.: 10/335,255

(22) Filed: Dec. 31, 2002

(65) Prior Publication Data

US 2004/0127128 A1 Jul. 1, 2004

(51) Int. Cl.
*B32B 27/08* (2006.01)

(52) U.S. Cl. ..... 428/515

(58) Field of Classification Search ..... 442/333
See application file for complete search history.

(56) References Cited

U.S. PATENT DOCUMENTS 3,338,992 A 8/1967 Kinney
3,341,394 A 9/1967 Kinney
3,502,763 A 3/1970 Hartmann
3,542,615 A 11/1970 Dobo et al.
3,692,618 A 9/1972 Dorschner et al.
3,802,817 A 4/1974 Matsuki et al.
3,849,241 A 11/1974 Butin et al.
4,100,324 A 7/1978 Anderson et al.
4,340,563 A 7/1982 Appel et al.
4,494,629 A 1/1985 Raeburn
4,522,203 A 6/1985 Mays
4,652,487 A 3/1987 Morman
4,655,760 A 4/1987 Morman et al.
4,657,802 A * 4/1987 Morman ..... 428/152
4,663,220 A * 5/1987 Wisneski et al. ..... 428/221
4,681,792 A * 7/1987 Harpell et al. ..... 428/102
4,692,371 A * 9/1987 Morman et al. ..... 442/329
4,720,415 A 1/1988 Vander Wielen et al.
4,734,311 A * 3/1988 Sokolowski ..... 428/152
4,734,324 A 3/1988 Hill
4,789,699 A 12/1988 Kieffer et al.
4,818,464 A 4/1989 Lau
4,861,652 A * 8/1989 Lippert et al. ..... 428/152
4,883,549 A 11/1989 Frost et al.
4,892,903 A 1/1990 Himes
4,965,122 A 10/1990 Morman
4,981,747 A * 1/1991 Morman ..... 428/198
5,093,422 A 3/1992 Himes
5,114,781 A 5/1992 Morman
5,116,662 A 5/1992 Morman
5,169,706 A 12/1992 Collier, IV et al.
5,207,970 A * 5/1993 Joseph et al. ..... 264/518
5,226,992 A 7/1993 Morman
5,260,126 A 11/1993 Collier, IV et al.
5,288,791 A 2/1994 Collier, IV et al.
5,304,599 A 4/1994 Himes
5,308,906 A 5/1994 Taylor et al.
5,332,613 A 7/1994 Taylor et al.
5,336,545 A 8/1994 Morman
5,350,624 A 9/1994 Georger et al.
5,366,793 A 11/1994 Fitts, Jr. et al.
5,382,400 A 1/1995 Pike et al.
5,385,775 A 1/1995 Wright
5,405,682 A 4/1995 Shawyer et al.
5,425,987 A 6/1995 Shawyer et al.
5,503,908 A 4/1996 Faass
5,514,470 A 5/1996 Haffner et al.
5,536,563 A 7/1996 Shah et al.
5,599,585 A 2/1997 Cohen
5,624,729 A 4/1997 Cohen et al.
5,633,286 A 5/1997 Chen
5,645,542 A * 7/1997 Anjur et al. ..... 604/368
5,674,212 A * 10/1997 Osborn et al. ..... 604/385.16

(Continued)

FOREIGN PATENT DOCUMENTS

EP 0560384 A1 9/1993

(Continued)

OTHER PUBLICATIONS

*Septon™: High Performance Thermoplastic Rubber*, Product Information Bulletin, Kuraray. Co., Ltd., © 2002.

(Continued)

*Primary Examiner*—Sheeba Ahmed
(74) *Attorney, Agent, or Firm*—Dority & Manning, P.A.

(57) ABSTRACT

The present invention is directed to improved elastic materials. More specifically, the present invention is directed to low basis weight elastic webs, such as elastic films and elastomeric fibrous meltblown or spunbond webs which may include elastomeric fibers and/or elastomeric continuous filaments. The present invention is also directed to laminate structures which include the elastic webs. The elastic webs include an elastomeric block copolymer and a polyolefin wax, and do not include a tackifier. The low basis weight elastic webs of the present invention may display tension values upon elongation equal to or greater than the tension values of previously known elastic webs of greater basis weight. The elastic laminate structures of the present invention comprise at least one layer an elastic web adhesively bonded to one or more other webs, such as, for instance a woven or nonwoven web. The elastic laminate structures made in accordance with the invention have shown remarkably good uniformity, hand, bulk, strength and elastic properties while decreasing the required amount of raw materials. In addition, the individual layers of the disclosed laminate structure may shown improved compatibility with each other and may display improved bonding between layers.

37 Claims, 10 Drawing Sheets

U.S. PATENT DOCUMENTS

| | | | | |
|---|---|---|---|---|
| 5,759,926 | A | 6/1998 | Pike et al. | |
| 5,760,117 | A | 6/1998 | Chen | |
| 5,789,065 | A | 8/1998 | Haffner et al. | |
| 5,804,021 | A | 9/1998 | Abuto et al. | |
| 5,843,068 | A | 12/1998 | Allen et al. | |
| 5,951,536 | A * | 9/1999 | Osborn et al. | 604/387 |
| 5,962,572 | A | 10/1999 | Chen | |
| 5,994,450 | A | 11/1999 | Pearce | |
| 6,057,024 | A | 5/2000 | Mleziva et al. | |
| 6,059,764 | A * | 5/2000 | Osborn et al. | 604/385.22 |
| 6,156,818 | A | 12/2000 | Corzani et al. | |
| 6,187,837 | B1 | 2/2001 | Pearce | |
| 6,187,989 | B1 | 2/2001 | Corzani et al. | |
| 6,200,669 | B1 | 3/2001 | Marmon et al. | |
| 6,287,288 | B1 * | 9/2001 | Osborn et al. | 604/385.04 |
| 6,323,389 | B1 | 11/2001 | Thomas et al. | |
| 6,362,389 | B1 | 3/2002 | McDowall et al. | |
| 6,387,471 | B1 | 5/2002 | Taylor et al. | |
| 6,626,879 | B1 * | 9/2003 | Ashton et al. | 604/385.03 |
| 2002/0147273 | A1 * | 10/2002 | Patel et al. | 525/93 |
| 2004/0110442 | A1 * | 6/2004 | Rhim et al. | 442/361 |

FOREIGN PATENT DOCUMENTS

| | | | |
|---|---|---|---|
| EP | 0 854 174 | * | 7/1998 |
| WO | WO 9628113 | A1 | 9/1996 |
| WO | WO 9827915 | A1 | 7/1998 |
| WO | WO 9827916 | A1 | 7/1998 |
| WO | WO 0038918 | A1 | 7/2000 |
| WO | WO 0152132 | A2 | 8/2001 |
| WO | WO 0154900 | A1 | 8/2001 |
| WO | WO 0187588 | A2 | 11/2001 |

OTHER PUBLICATIONS

Technical Bulletin—*KRATON® Thermoplastic Rubbers In Oil Gels*, SC: 1102-89, 10 pages, Shell Chemical Company.

Technical Bulletin—*Kraton Polymers*, 44 pages, Shell Chemical Company.

Technical Bulletin—*KRATON® D and G Polymer Compounds*, 20 pages, Shell Chemical Company.

Technical Bulletin—*KRATON® Polymers*, 35 pages, Shell Chemical Company.

* cited by examiner

ELASTOMERIC MATERIALS

BACKGROUND OF THE INVENTION

Elastomeric materials have been used in the past in countless different applications. For instance, waist bands, leg bands, feminine care products, adult care products, and diapers employ elastic components in order to supply such articles with elastic properties and a better fit. In many applications, elastic materials are bonded to one or more other layers in order to form laminated structures in these and other applications.

In U.S. Pat. No. 4,657,802 to Morman, a process for producing a composite nonwoven elastic web including a nonwoven elastic web joined to a fibrous nonwoven gathered web is disclosed. The process includes the steps of (a) providing a nonwoven elastic web having a relaxed unbiased length and a stretched, biased length; (b) stretching the nonwoven elastic web to its stretched, biased length; (c) forming a fibrous nonwoven gatherable web directly upon a surface of the nonwoven elastic web while maintaining the nonwoven elastic web at its stretched, biased length; (d) forming a composite nonwoven elastic web by joining the fibrous nonwoven gatherable web to the nonwoven elastic web while continuing to maintain the nonwoven elastic web at its stretched length; and (e) relaxing the nonwoven elastic web to its relaxed length to gather the fibrous nonwoven gatherable web. The joining of the fibrous nonwoven gatherable web to the nonwoven web is achieved by heat-bonding or sonic bonding to fuse the two webs to each other.

In U.S. Pat. No. 4,720,415 to Vander Wielen, et al., a method of producing a composite elastic material is disclosed which comprises stretching an elastic web to elongate it, for example elongating a nonwoven web of meltblown elastomeric fibers, and bonding the elongated web to at least one gatherable web, such as a spunbonded polyester fiber material, under conditions which soften at least a portion of the elastic web to form the bonded composite web of elastic material.

The above-described patents represent great advancements in the art. The present invention is directed to further improvements in elastic materials which display good elastic characteristics at low basis weights and laminated elastic formations which display good compatibility between layers and excellent bonding while decreasing production costs and simplifying production of the personal care products formed from the materials.

SUMMARY

The present invention is directed to elastic webs and laminate structures which include the elastic webs.

The elastic webs of the present invention comprise one or more elastomeric block copolymers. The elastomeric block copolymers include at least one thermoplastic block which includes a styrenic moiety and at least one elastomeric polymer block which may be a conjugated diene, a lower alkene polymer, or their saturated equivalents. For example, the elastomeric block copolymer may be a multi-block copolymer such as, for example, a di-block copolymer, a tri-block copolymer, or a tetra-block copolymer. In various embodiments, the elastomeric polymer block(s) may include an ethylene-propylene block, an ethylene-butylene block, or combinations of elastomeric polymer blocks. The elastic web may be a fibrous nonwoven web, such as a meltblown web, a spunbond web, or a coform web, or may be an elastic film. Furthermore, in one embodiment, the elastic web may include elastic filaments.

In addition to the elastomeric block copolymer, the elastic webs of the present invention include up to about 50% by weight of a polyolefin wax. For example, the elastic web may include between about 5% and about 40% by weight of a polyolefin wax. In one embodiment, the polyolefin wax may be a polyethylene wax, a polypropylene wax, a polybutene wax, or a mixture of these waxes. In one embodiment, the polyolefin wax may include a copolymer.

In one embodiment, the elastic web is substantially free of a tackifier.

In one embodiment, the elastic web of the present invention may have a basis weight of less than about 12 gsm and may display 450 grams-force tension when elongated by about 50% of its resting length.

The present invention is also directed to elastic laminate structures which include the elastic web as a layer of the laminate structure. For example, the laminate structures may include at least two, but optionally more, layers. In general, adjacent layers of the laminate structure may be adhesively secured together. In one embodiment, adjacent layers of the web may be adhesively secured together with a spray adhesive which is not a hot melt adhesive, such that added heat is not required to bond the layers of the laminate together.

The second web of the laminate structure may, in one embodiment, be a nonwoven web. For example, the second web may be a meltblown or spunbond web and may comprise polyolefin fibers. For instance, the second web may be a polyolefin fibrous web comprising polyethylene and/or polypropylene fibers. In one embodiment, the second web may comprise bicomponent polyolefin fibers.

In one embodiment of the present invention, the polyolefin wax in the elastic web and the polyolefin fibers in the adjacent web of the laminate structure may comprise the same polyolefin.

In general, the elastic laminate structure may be either a stretch-bonded laminate or a neck-bonded laminate.

The present invention is also directed to personal care products which may include the elastic laminate structures. For example, the personal care products of the present invention may include disposable elastic garments such as incontinence garments, disposable diapers, and disposable training pants. Other personal care products formed including the disclosed laminate structure may include protective covers, feminine hygiene pads, incontinence control pads, and the like.

BRIEF DESCRIPTION OF THE FIGURES

A full and enabling disclosure of the present invention, including the best mode thereof to one of ordinary skill in the art, is set forth more particularly in the remainder of the specification, including reference to the accompanying figures in which.

Figure 1:
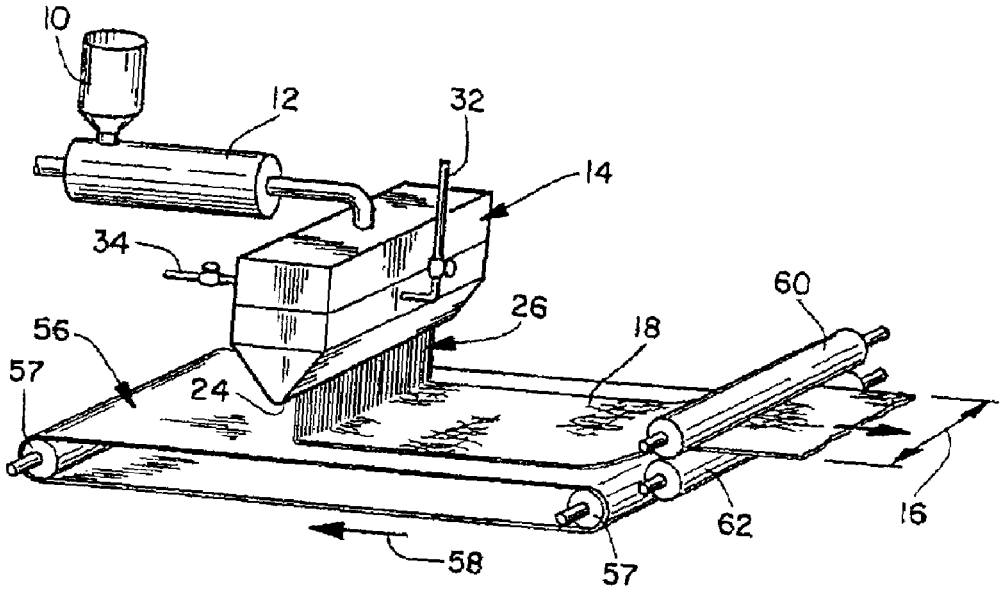
FIG. 1 is a perspective schematic view illustrating one embodiment of a process for forming a nonwoven elastomeric web in accordance with the present invention.

Repeat use of reference characters in the present specification and drawings is intended to represent same or analogous features or elements of the present invention.

DETAILED DESCRIPTION OF THE INVENTION

Reference will now be made in detail to various embodiments of the invention, one or more examples of which are set forth below. Each embodiment is provided by way of explanation of the invention, not limitation of the invention. In fact, it will be apparent to those skilled in the art that various modifications and variations may be made in the present invention without departing from the scope or spirit of the invention. For instance, features illustrated or described as part of one embodiment, may be used on another embodiment to yield a still further embodiment. Thus, it is intended that the present invention cover such modifications and variations as come within the scope of the appended claims and their equivalents.

The present invention is directed to improved elastic materials. More specifically, the present invention is directed to low basis weight elastic webs, such as, for example, elastic films and elastomeric fibrous webs. Elastomeric fibrous webs of the present invention may include elastic meltblown or spunbond fibers and/or filaments. The low basis weight elastic webs of the present invention may display excellent mechanical characteristics. For example, in certain embodiments, the low basis weight elastic webs of the present invention may display tension values upon elongation equal to or greater than the tension values of previously known elastic webs of greater basis weight.

The present invention is also directed to elastic laminate structures which include the disclosed elastic webs as at least one layer of the laminate structure. More specifically, the elastic laminate structures of the present invention comprise at least one layer of an elastic web according to the present disclosure adhesively bonded to one or more other webs, such as, for instance a woven or nonwoven web so as to form an elastic laminate structure.

The elastic laminate structures made in accordance with the invention have shown remarkably good uniformity, hand, bulk, strength and elastic properties while decreasing the required amount of raw materials. In addition, the individual layers of the disclosed laminate structure have shown improved compatibility with each other and may display improved adhesive bonding between layers.

A wide variety of elastomeric materials may be included in the formulation used to form the elastic webs. As used herein and in the claims, the terms "elastic" and "elastomeric" have their usual broad meanings. However, for purposes of this invention, "elastic" may be conveniently defined as follows: A material is elastic if it is stretchable to an elongation of at least about 25 percent of its relaxed length, i.e., can be stretched to at least about one and one-quarter times its relaxed length, and upon release of the stretching force will recover at least about 40 percent of the elongation, i.e., will, in the case of 25% elongation, contract to an elongation of not more than about 15%. For example, a 100 centimeter length of material will, under the foregoing definition, be deemed to be elastic if it can be stretched to a length of at least about 125 centimeters and if, upon release of the stretching force, it contracts, in the case of being stretched to 125 cm, to a length of not more than about 115 centimeters. Of course, many elastic materials used in the practice of the invention can be stretched to elongations considerably in excess of 25% of their relaxed length, and many, upon release of the stretching force, will recover to their original relaxed length or very close thereto.

Elastic webs of the invention include both elastic films and nonwoven fibrous elastic webs. Nonwoven fibrous elastic webs include fibrous webs formed of elastomeric meltblown or spunbond fibers or filaments, as well as mixtures of elastomeric filaments and fibers. In one embodiment, meltblown and spunbond elastomeric fibrous webs may comprise "microfibers", which is herein defined to include fibers of a diameter not greater than about 100 microns, e.g., fibers of from about 1 to 50 microns in diameter, such as those which may be obtained by either the meltblowing or spunbonding processes.

As used herein "meltblown" microfibers are defined as small diameter fibers, usually of a diameter not greater than about 100 microns, made by extruding a molten thermoplastic material as molten threads through a plurality of orifices into a high velocity gas (e.g., air) stream which may entrain the extruded threads at their point of emergence from the orifices and may attenuate the threads of molten thermoplastic material to reduce the diameter thereof. The gas streamborne fibers then being deposited upon a collecting screen to form a coherent web of randomly dispersed fibers. Such a process is disclosed, for example, in U.S. Pat. No. 3,849,241 issued Nov. 19, 1974, to Butin, et al, which is herein incorporated by reference thereto as to all relevant material.

As used herein, the term "spunbond fibers" refers to small diameter fibers of molecularly oriented polymeric material. Spunbond fibers may be formed by extruding molten thermoplastic material as filaments from a plurality of fine, usually circular capillaries of a spinneret with the diameter of the extruded filaments then being rapidly reduced as in, for example, U.S. Pat. No. 4,340,563 to Appel, et al., U.S. Pat. No. 3,692,618 to Dorschner, et al., U.S. Pat. No. 3,802,817 to Matsuki, et al., U.S. Pat. Nos. 3,338,992 and 3,341,394 to Kinney, U.S. Pat. No. 3,502,763 to Hartman, U.S. Pat. No. 3,542,615 to Dobo et al., and U.S. Pat. No. 5,382,400 to Pike, et al. Spunbond fibers are generally not tacky when they are deposited onto a collecting surface and are generally continuous. Spunbond fibers are often about 10 microns or greater in diameter. However, the fine fiber spunbond webs (have an average fiber diameter less than about 10 microns) may be achieved by various methods including, but not limited to, those described in commonly assigned U.S. Pat. No. 6,200,669 to Marmon, et al., and U.S. Pat. No. 5,759,926 to Pike, et al., each is hereby incorporated by reference in its entirety.

The meltblown or spunbond fibers of the present invention are not limited to microfibers, however. In some embodiments, larger fibers may be formed of the elastic materials. In general, any suitable fiber sizes may be utilized in the present invention, including, for example, fibers having an average diameter up to and, in some embodiments, greater than about 100 microns in diameter.

The elastic materials of the present invention may also include elastomeric filaments which may form a nonwoven fibrous elastic web. The inclusion of continuous filaments in a fibrous web may improve the tenacity of the fibrous web. For example, in one embodiment, elastomeric continuous filaments may be included in an elastic web and may extend along the length (i.e. machine direction) of the fibrous web. Elastomeric filaments of the present invention may generally have an average diameter in the range from about 50 to about 800 microns, for example, from about 100 to about 200 microns. In one embodiment, a layer of substantially parallel continuous filaments formed from the presently disclosed elastic formulation may be included in a nonwoven fibrous web wherein the filaments are formed at a density per inch of width of material ranging from about 10 to about 120 filaments per inch width of material. Examples of elastic webs including substantially parallel elastomeric continuous filaments such as may be utilized in the present invention are described in U.S. Pat. No. 5,385,775 to Wright, which is herein incorporated by reference thereto as to all relevant matter.

A nonwoven fibrous elastic web may also comprise a composite material in that it may comprise two or more individual coherent webs or it may comprise one or more webs individually comprised of a mixture of elastic fibers and/or filaments according to the present invention with other discrete particles, for example other fibers. For example, a nonwoven fibrous elastic web may be a coform web. As used herein, the term "coform nonwoven web" or "coform material" means composite materials comprising a mixture or stabilized matrix of thermoplastic filaments and at least one additional material, usually called the "second material" or the "secondary material." As an example, coform materials may be made by a process in which at least one meltblown die head is arranged near a chute through which the second material is added to the web while it is forming. The second material may be, for example, an absorbent materials such as fibrous organic materials such as woody and non-woody cellulosic fibers, including regenerated fibers such as cotton, rayon, recycled paper, pulp fluff; superabsorbent materials such as superabsorbent particles and fibers; inorganic absorbent materials and treated polymeric staple fibers and the like; or a non-absorbent material, such as non-absorbent staple fibers or non-absorbent particles. Exemplary coform materials are disclosed in commonly assigned U.S. Pat. No. 5,350,624 to Georger, et al., U.S. Pat. No. 4,100,324 to Anderson, et al., and U.S. Pat. No. 4,818,464 to Lau, et al., the entire contents of each is hereby incorporated by reference.

In general, the elastic materials of the present invention are formed from a thermoplastic elastic formulation including elastomeric block copolymers. For example, multi-block copolymers including, for instance, di-block copolymers having the general formula A-B, tri-block copolymers having the general formula A-B-A', or tetrablock copolymers having the general formula A-B-A'-B' or A-B-B'-A', where A and A' are the same or different, and B and B' are the same or different may be used. A and A' each being a thermoplastic polymer block which contains a styrenic moiety and B and B' being an elastomeric polymer block such as a conjugated diene or a lower alkene polymer or their saturated equivalents. In general, the elastomeric block copolymers of the present invention may contain up to about 35% styrene. For example, the block copolymers may contain from about 15% to about 30% styrene. In one embodiment, block copolymers such as those available from Kraton Polymers of Houston, Tex. under the brand name KRATON® or those available from Dexco Polymers of Palquemine, La. under the trade name VECTOR™ may be used. In these block copolymers, the polystyrene is a thermoplastic with a glass transition temperature above room temperature ($T_g$ about 75° C.) and the elastomeric block is a rubber with a glass transition temperature well below room temperature. As such, the polystyrene and the elastomeric block are thermodynamically incompatible. Because of this incompatibility, the polystyrene blocks, being in minor proportion in the elastomeric polymer, may unite to form polystyrene domains that may be uniformly distributed throughout the elastomeric material. This creates a stable matrix similar to that of vulcanized polybutadiene, natural rubber, or styrene-butadiene rubber.

As used herein the term "styrenic moiety" is defined as a monomeric unit represented by the formula:

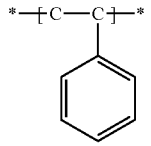

In one embodiment, the A and A' blocks may be selected from the group including polystyrene and polystyrene homologs such as poly(alpha-methylstyrene).

In one embodiment, the B and B' blocks may be polyisoprene, poly(ethylene-propylene), polyethylene, polybutadiene, or poly(ethylene-butylene).

In one embodiment of the elastic material, elastomeric block copolymers may be utilized having a saturated or essentially saturated poly(ethylene-propylene) elastomeric block B and/or B' segments having the following general formula:

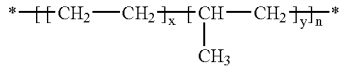

where x, y, and n are positive integers, and polystyrene A and/or A' segments represented by the formula:

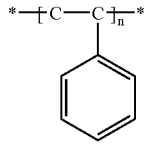

where n is a positive integer. Such elastomeric block copolymers are sometimes referred to as S-EP-S (polystyrene/poly (ethylene-propylene)/polystyrene) tri-block copolymers or S-EP-S-EP (polystyrene/poly(ethylene-propylene)/polystyrene/poly (ethylene-propylene)) tetra-block copolymers. Specific embodiments of these block copolymers are available under the trademark KRATON® G, for example, KRATON® G 1701, KRATON® G 1702 and KRATON® G 1730 from Kraton Polymers of Houston, Tex. KRATON® G 1701 has a block styrene percent mass of 37%, a Shore A hardness of 64, and a solution viscosity of 50 Pa.s at 25% mass in toluene at 25° C. KRATON® G 1702 has a block styrene percent mass of 28%, a Shore A hardness of 41, and a solution viscosity of 50 Pa.s at 25% mass in toluene at 25° C. KRATON® G 1730 has a block styrene percent mass of 21% and a Shore A hardness of 66. In one embodiment, these exemplary ethylene-propylene block copolymers may also be combined with radial S-EP-S block copolymers, such as those designated G-1750 and G-1765 available from the Kraton Polymers Company.

In another embodiment, block copolymers including poly (ethylene-propylene) B segments and polyethylene B' segments may be utilized represented by the formula:

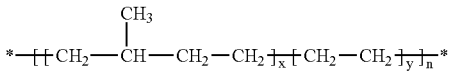

where x, y and n are positive integers, and polystyrene A and A' blocks as defined above may be used. These block copolymers are sometimes referred to as S-E-EP-S (polystyrene/polyethylene/poly(ethylene-propylene)/polystyrene) block copolymers, and are available under the trademark Septon.4033, Septon.4044, Septon.4055, and Septon.4077 from the Septon Company of America of Pasadena, Tex. Septon.4033 has a styrene content of about 30 wt %, a Shore A hardness of about 78, and a 10 wt % solution viscosity of 50 mPa-s. Septon.4044 has a styrene content of about 32 wt %, and a 10 wt % solution viscosity of 480 mPa-s. Septon.4055 has a styrene content of about 30 wt %, and a 10 wt % solution viscosity of 5800mPa-s. Septon.4077 has a styrene content of about 30 wt %, and a 5 wt % solution viscosity of 300 mPa-s.

In another embodiment, block copolymers including poly (ethylene-butylene) B and/or B' segments may be utilized represented by the formula:

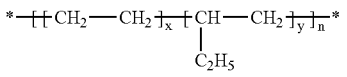

where x, y and n are positive integers, and polystyrene A and A' blocks as defined above may be used. These block copolymers are sometimes referred to as S-EB-S (polystyrene/poly (ethylene-butylene)/polystyrene) tri-block copolymers, and are available under the trademark KRATON G, for example, KRATON G 1650, KRATON G 1652 and KRATON GX 1657 from Kraton Polymers of Houston, Tex. KRATON G 1650 has a block styrene percent mass of 30%, a Shore A hardness of 72, and a solution viscosity of 8 Pa.s at 25% mass in toluene at 25° C. KRATON G 1652 has a block styrene percent mass of 30%, a Shore A hardness of 75, and a solution viscosity of 1.35 Pa.s at 25% mass in toluene at 25° C. KRATON GX 1657 has a block styrene percent mass of 13% and a Shore A hardness of 47.

Other elastomeric resins which may be utilized in forming the elastic materials of the present invention include block copolymers where A and A' are polystyrene blocks, as defined above, and B and/or B' is a polybutadiene block represented by the following formula:

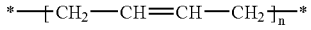

where n is a positive integer. This material is sometimes referred to as a S-B-S tri-block copolymer and is available from Kraton Polymers of Houston, Tex. under the trade designation KRATON D; for example, KRATON D 1101, KRATON D 1102 and KRATON D 1116. According to the Kraton Polymers Company, KRATON D 1101 has a block styrene percent mass of 31%, a Shore A hardness of 69, and a solution viscosity of 4 Pa.s at 25% mass in toluene at 25° C. KRATON D 1102 has a block styrene percent mass of 28% and a Shore A hardness of 66. KRATON D 1116 has a block styrene percent mass of 23%, a Shore A hardness of 63, and a solution viscosity of 9 Pa.s at 25% mass in toluene at 25° C. These block copolymers are available as porous pellets and have a specific gravity of 0.94.

Another S-B-S block copolymer suitable for use in the elastic materials of the present invention is commercially available under the trade designation Solprene® and Calprene® from the Dynasol Company of Houston, Tex.

Other elastomeric resins which may be utilized to form the elastic webs of the present invention are block copolymers where A and A' are polystyrene blocks, as defined above, and B and/or B' are polyisoprene blocks where the polyisoprene block may be represented by the formula:

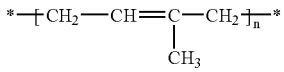

where n is a positive integer. These block copolymers are sometimes referred to as S-I-S tri-block copolymers and are also available from Kraton Polymers under the trade designation KRATON D, for example, KRATON D 1107, KRATON D 1111, KRATON D 1112 and KRATON D 1117. KRATON D 1107 has a block styrene percent mass of 15%, a Shore A hardness of 32, and a solution viscosity of 1.6 Pa.s at 25% mass in toluene at 25° C. KRATON D 1111 has a block styrene percent mass of 22%, a Shore A hardness of 45, and a solution viscosity of 1.2 Pa.s at 25% mass in toluene at 25° C. KRATON D 1112 has a block styrene percent mass of 15%, a Shore A hardness of 25, and a solution viscosity of 0.9 Pa.s at 25% mass in toluene at 25° C. KRATON D 1117 has a block styrene percent mass of 17%, a Shore A hardness of 32, and a solution viscosity of 0.7 Pa.s at 25% mass in toluene at 25° C. The D 1111 grade is available as a porous pellet having a specific gravity of 0.93. The D 1107, D 1112 and D 1117 block copolymers are available as pellets having specific gravities of 0.92.

These exemplary block copolymers are not believed to contain plasticizer oils although they are commercially available in compounded form.

It should be understood that the elastic materials of the present invention are not limited to the foregoing list of exemplary elastomeric block copolymers and other suitable elastomeric block copolymers may alternatively be utilized in the disclosed elastic webs.

In accordance with the present invention, in addition to the elastomeric block copolymers, the thermoplastic elastic formulation used to form the elastic webs includes a low molecular weight polyolefin polymer or oligomer wax of varying crystallinity and/or tacticity. Specifically, a polyolefin wax may be utilized which is miscible with the elastomeric block copolymer at processing temperatures. This will have the beneficial effect of improving processability of the elastomeric block copolymer by lowering the viscosity of the thermoplastic elastic formulation at processing conditions.

Additional benefits may be gained by the addition of the polyolefin wax to the elastic formulation, as well. For example, it has been discovered that at use conditions, the presence of the polyolefin wax in the thermoplastic elastic formulation may provide an elastic web with increased modulus per unit of basis weight. For purposes of this disclosure, "modulus" is herein defined to be the Young's modulus of the elastic material, i.e., the ratio of tension stress applied to the material and the resulting strain parallel to the tension when the material is elongated. More specifically, it is believed that due to the low molecular weight of the polyolefin wax as well as the compatibility between the polyolefin wax and the elastomeric material, a polyolefin wax may be chosen which is not miscible with the rubber or hard segment molecular organization of the elastomeric block copolymer at use conditions. As such, the polyolefin wax will not interfere with the ability of the elastomeric material to act as an elastomer. In addition, it is believed that the polyolefin wax molecules may unite to form crystalline domains within the elastic network which may reinforce the elastomeric matrix of the material at use conditions and further improve the characteristics of the material. The molecular weight of the polyolefin wax is important because, at high molecular weights the polyolefin wax could interfere with the incompatible rubber network of the web and result in substantial loss of dimensional (creep) stability of the web. Tacticity of the polyolefin wax may also affect the compatibility of the wax with the blocks in the block copolymer. In sum, the addition of the polyolefin wax to the elastomeric formulation may provide increased tension in the elastic web formed by the process as a function of elongation and composition.

Figure 8:
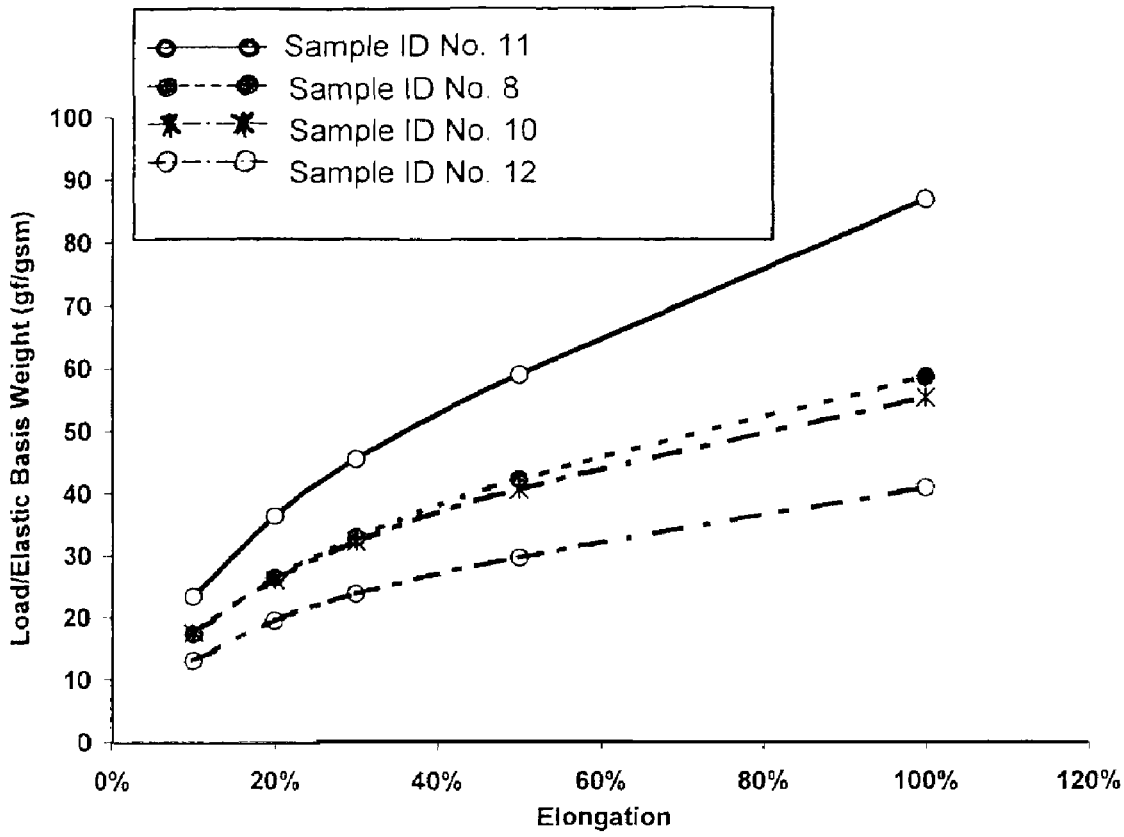
FIG. 8 is a graph depicting normalized load as a function of elongation for materials of the present invention at room temperature.
Figure 9:
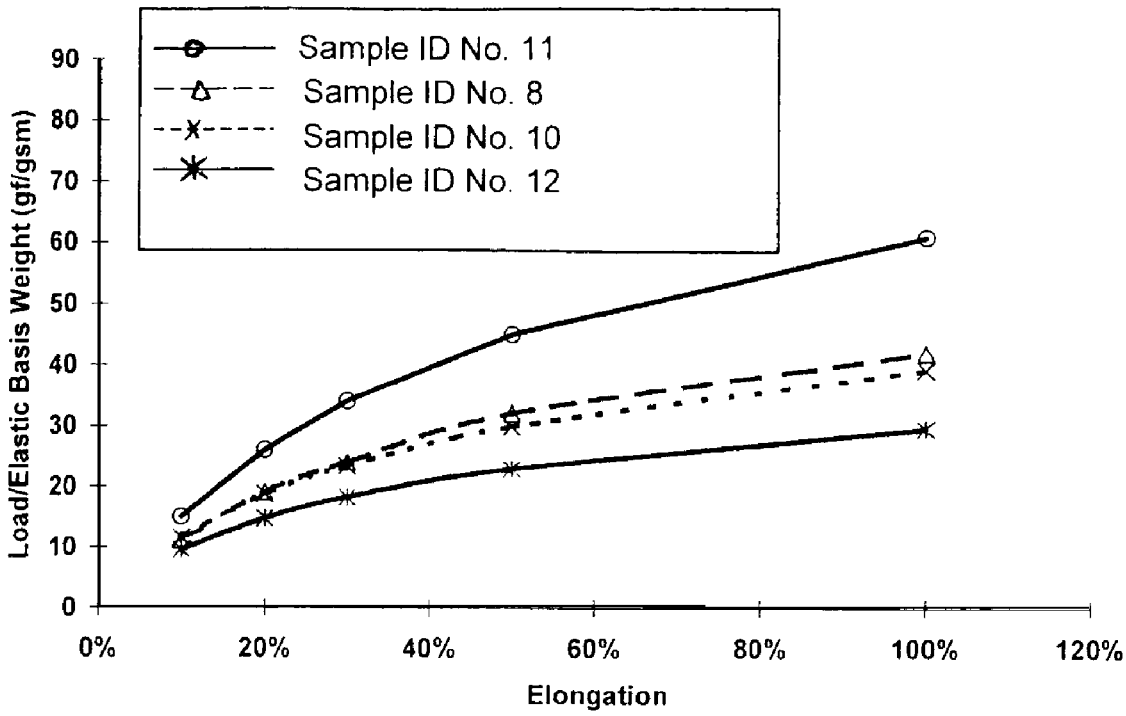
FIG. 9 is a graph depicting normalized load as a function of elongation for materials of the present invention at body temperature.

FIGS. 8 and 9, which will be further described herein, illustrate the increase in load at elongation for materials formed according to the present invention having various elastomeric block copolymer to wax ratios. As can be seen, an increase in the relative amount of polyolefin wax added to the formulation translates to an increase in load at a certain elongation. This trend continues up to a maximum fraction of polyolefin wax in the formulation, at which point the presence of the polyolefin wax may begin to interfere with the elastic properties of the web. The maximum fraction of polyolefin wax in the formulation is generally about 50% by weight.

The modulus of the elastic web may generally be described as follows:

$$E_m = \Phi_p E_p + \Phi_w E_w$$

wherein: $E_m$ is the modulus of the elastic material $E_p$ is the modulus of the polymer $E_w$ is the modulus of the polyolefin wax $\Phi_p$ is the volume fraction of the polymer in the formulation $\Phi_w$ is the volume fraction of the polyolefin wax in the formulation In general, the polyolefin wax which may be blended with the elastomeric block copolymers in the thermoplastic elastic formulation will be a polyolefin wax which, when blended with the block copolymer and subjected to an appropriate combination of pressure and temperature conditions forms an extrudable thermoplastic formulation. For example, suitable polyolefin wax materials may include polyethylene, polypropylene and polybutene, including ethylene copolymers, propylene copolymers and butene copolymers. In addition, blends of two or more polyolefin waxes may be utilized.

In general, the polyolefin wax may be added to the thermoplastic elastic formulation in an amount of up to about 50% by weight. Beyond that amount, the presence of the polyolefin wax may begin to interfere with the elastic properties of the formed elastic web. In one embodiment, the thermoplastic elastic formulation may be between about 20% and about 40% by weight polyolefin wax. For example, in one embodiment, the formulation may include from about 60 wt % to about 95 wt % block copolymer and from about 5 wt % to about 40 wt % polyolefin wax. Alternatively, the blend may include from about 70 wt % to about 90 wt % elastomeric block copolymer and from about 10 wt % to about 30 wt % polyolefin wax.

In one embodiment, a suitable polyethylene wax may be obtained from Equistar Chemicals of Houston, Tex., under the trade designation Petrothene Na601. (Also referred to as PE Na601 or Na601.) In another embodiment, a polypropylene wax may be utilized which may be obtained from the Himont Corporation under the trade designation PC-973.

According to the U.S.I. Chemical Company, Na601 is a low molecular weight, low-density polyethylene for application in the past in the areas of hot melt adhesives and coatings. Na601 has the following nominal values:

- a Brookfield Viscosity at 150° C. of 8500 cP and at 190° C. of 3300 cP when measured in accordance with ASTM D 3236
- a density of 0.903 g/cc when measured in accordance with ASTM D 1505
- an equivalent Melt index of 2,000 grams per ten minutes when measured in accordance with ASTM D 1238
- a ring and ball softening point of 102° C. when measured in accordance with ASTM E 28
- a tensile strength of 850 pounds per square inch when measured in accordance with ASTM D 638
- an elongation of 90% when measured in accordance with ASTM D 638
- a modulus of Rigidity, $T_F$ (45,000) of −34° C.
- a penetration Hardness, (tenths of mm) at 77° F. of 3.6

In one embodiment, Na601 polyethylene is believed to have a number average molecular weight ($M_n$) of about 4,600; a weight average molecular weight ($M_w$) of about 22,400 and a Z average molecular weight ($M_z$) of about 83,300. The polydispersity ($M_w/M_n$) of the Na601 is about 4.87.

Typical characteristics of Himont PC-973 polypropylene include:

- a density of about 0.900 grams per cubic centimeter measured in accordance with ASTM D 792
- a meltflow rate (MFR) obtained in accordance with ASTM D 1238, Condition L, of about 35 grams per ten minutes
- a tensile strength of about 4,300 pounds per square inch (psi) measured in accordance with ASTM D638
- a flex modulus of about 182,000 psi measured in accordance with ASTM D 790, B
- a Rockwell hardness, R scale, of about 93 measured in accordance with ASTM D 785A PC-973 is believed to have a number average molecular weight ($M_n$) of about 40,100, a weight average molecular weight ($M_w$) of about 172,000 and a Z average weight ($M_z$) of about 674,000. The polydispersity of the PC-973 ($M_w/M_n$) is about 4.29.

The polyolefin waxes suitable for use in the present invention may generally have a number average molecular weight ($M_w$) up to about 50,000. The polyolefin waxes suitable for use in the present invention may also have a polydispersity ($M_w/M_n$) of between about 2 and about 5.

The thermoplastic elastomeric formulation used in the present invention may contain, in addition to the elastomeric block copolymers and a polyolefin wax, plasticizers, pigments, antioxidants and other conventionally employed additives. However, the thermoplastic elastic formulation used in the invention will not, in general, include the addition of a tackifier.

Tackifiers are generally hydrocarbon resins, wood resins, rosins, rosin derivatives, and the like which have been used in elastomeric formulations in the past to decrease the viscosity of the elastomeric formulation at processing conditions, due to miscibility of the tackifier with the elastomer at use conditions. The tackifiers have been utilized as well to provide tacky elastomeric fibers and/or filaments that autogenously bond and thus tackifiers improved bondability of the product web in a laminate construction. Known tackifiers include hydrocarbon resins, rosin and rosin derivatives, polyterpenes and other similar materials. One such known tackifier is Wingtak 10, a synthetic polyterpene resin that is liquid at room temperature, and sold by the Goodyear Tire and Rubber Company of Akron, Ohio. Wingtak 95 is a synthetic tackifier resin also available from Goodyear that comprises predominantly a polymer derived from piperylene and isoprene. Other known tackifying additives utilized in the past include Escorez 1310, an aliphatic hydrocarbon resin, and Escorez 2596, a $C_5$-$C_9$ (aromatic modified aliphatic) resin, both manufactured by Exxon of Irving, Tex. Other tackifiers used in elastomeric formulations in the past include hydrogenated hydrocarbon resins such as REGALREZ™ and ARKON™. Terpene hydrocarbons have also been used in the past as tackifiers in elastomeric formulations including, for example, ZONATAK™ 501 lite.

It has been discovered that the addition of such tackifiers to an elastic formulation, while improving bondability and processability of the elastomeric formulation by lowering viscosity of the formulation, can have a detrimental effect on the elastic properties of the elastic web produced from the formulation, and as such, is to be avoided in certain embodiments of the present invention. More specifically, it is believed that the presence of tackifiers in the elastic formulations may reduce the modulus of the elastic materials due to interference of the tackifier with the hard segment of the block copolymer at use conditions. In addition, when using tackifiers in an elastomeric formulation over time, there may be tackifier build-up on the production machines during processing, leading to down time of the process line for cleaning.

In the past, some methods for forming elastic webs characterized by high modulus values involved increasing the basis weight of the web, effectually counteracting the unrecognized modulus decrease brought about due to the presence of tackifiers in the formulation. The thermoplastic elastic formulation of the present invention, in contrast, may be used to form very low basis weight elastic webs characterized by high modulus values. This increase in modulus is a result not only of removal of tackifiers, which may decrease the modulus of an elastic web, but also is a result of addition of a polyolefin wax, which may increase the modulus of an elastic web.

Another advantage of the thermoplastic elastic formulation of the present invention is due to improved processability of the formulation. In the past, the tackifiers added to the elastic formulations tended to sublime during processing. As a result, the production facility was subject to die-lip build up as well as fogging, both of which may result in down time for the production facility and resulting increased production costs. The thermoplastic elastic formulation of the present invention may not only produce improved elastic materials, but may do so with reduced production costs, through decreased amounts of raw materials required as well as through less down time during production of the webs.

The thermoplastic elastic formulation of the present invention may be utilized to form any type of elastic web. For example, the formulation may be utilized to form meltblown or spunbond elastic webs or elastic films.

In forming an elastic film, the components of the thermoplastic elastic formulation may be mixed together, heated and then extruded at suitable pressure and temperature using any one of a variety of film-producing processes known to those of ordinary skill in the film art including, for example, casting and blowing.

In another embodiment, the thermoplastic elastic formulation may be utilized to form an elastic fibrous nonwoven web. For example, the elastic formulation may be extruded to form meltblown or spunbond fibers and/or filaments so as to produce a meltblown or a spunbond nonwoven elastic web. In addition, in one embodiment, the elastic fibrous nonwoven web may be a coform web including elastic fibers according to the present invention combined with other discrete material to form a composite elastomeric nonwoven web.

Referring to FIG. 1, which schematically illustrates one embodiment of an apparatus for forming an elastomeric meltblown nonwoven web in accordance with the present invention, it can be seen that the thermoplastic elastic formulation of the present invention (not shown) may be supplied to a hopper 10 of an extruder 12. The components of the formulation may be supplied in pellet or any other suitable form.

The temperature of the formulation is elevated within the extruder 12 by a conventional heating arrangement (not shown) to melt and/or soften the formulation, and pressure is applied to the formulation by the pressure-applying action of a turning screw (not shown), located within the extruder, to form the formulation into an extrudable composition. Preferably the formulation is heated to a temperature of at least about 125° C. if the polyolefin wax in the formulation comprises polyethylene or at least about 175° C. if the polyolefin wax in the formulation comprises polypropylene. For example, the formulation may be heated in the extruder 12 to a temperature of from at least about 190° C. to about 300° C., more specifically, to a temperature of from at least about 200° C. to about 275° C.

The extrudable composition is then forwarded by the pressure applying action of the turning screw to a meltblowing die 14. The elevated temperature of the extrudable composition is maintained in the meltblowing die 14 by a conventional heating arrangement (not shown). The die 14 generally extends a width which is about equal to the width 16 of the nonwoven web 18 which is to be formed by the process. The combination of temperature and pressure conditions which effect extrusion of the composition will vary over wide ranges. For example, at higher temperatures, lower relative pressures will result in satisfactory extrusion rates and, at higher pressures of extrusion, lower temperatures will affect satisfactory extrusion rates.

Figure 2:
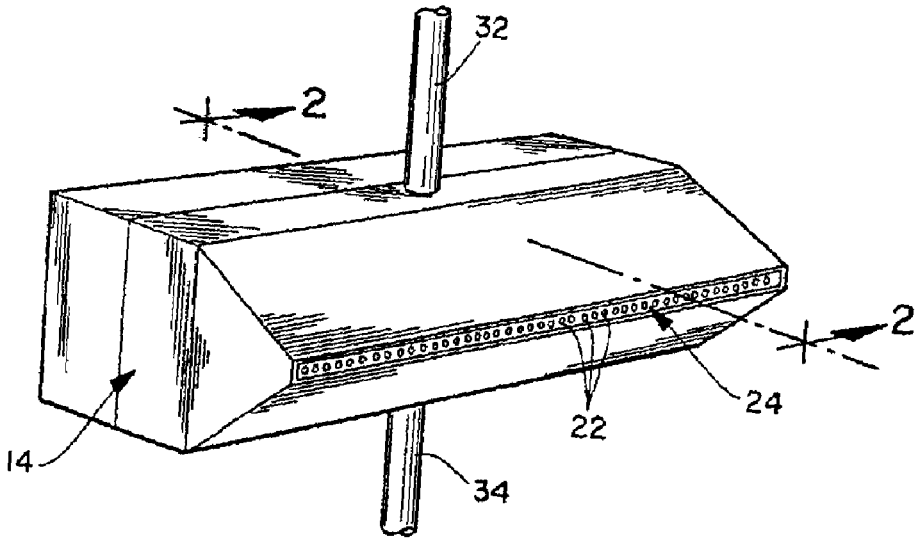
FIG. 2 is a perspective view of the meltblowing die illustrated in FIG. 1 which illustrates the linear arrangement of the capillaries of the die.
Figure 4:
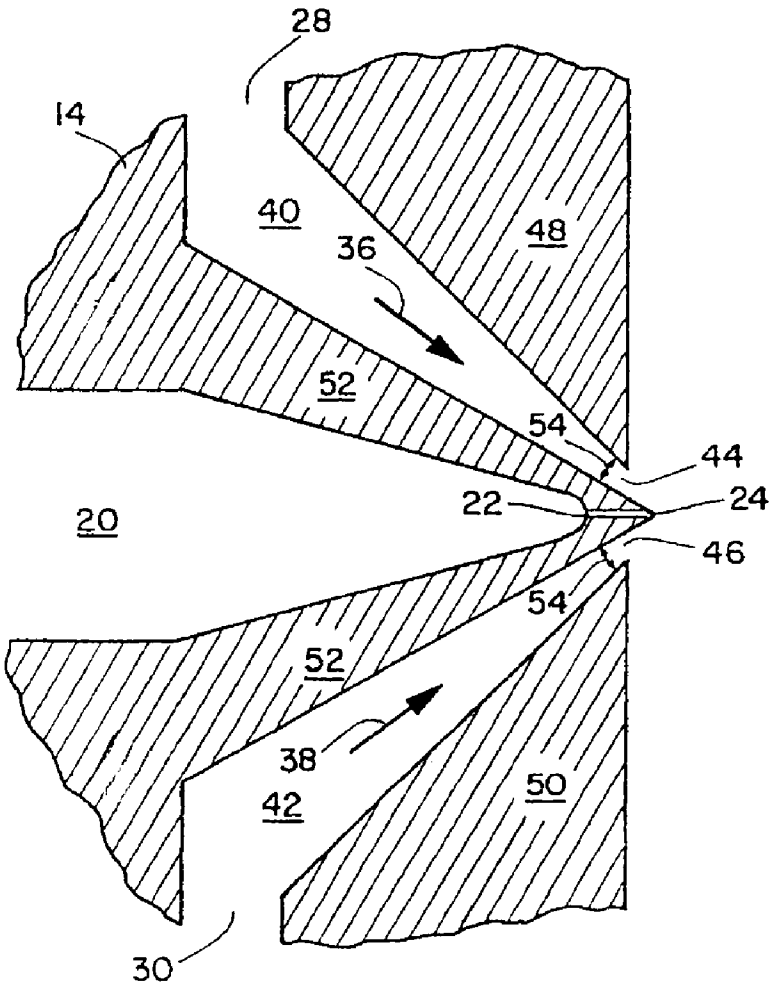
FIG. 4 is a schematic cross-sectional view of the die illustrated in FIG. 1, along line 2-2 of FIG. 2, illustrating the die in a protruding die tip arrangement.
Figure 3:
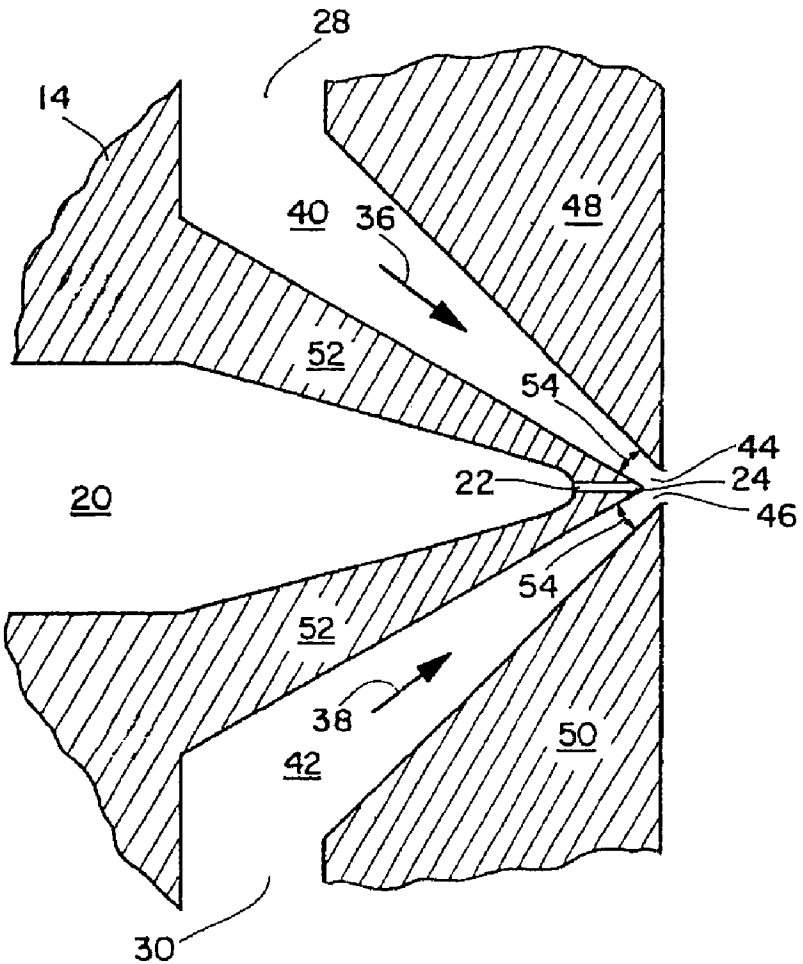
FIG. 3 is a schematic cross-sectional view of the die illustrated in FIG. 1, along line 2-2 of FIG. 2, illustrating the die in a recessed die tip arrangement.

FIGS. 3 and 4 illustrate cross-sectional view of the die illustrated in FIG. 2 along line 2-2 in recessed die tip arrangement (FIG. 3) and in protruding die tip arrangement (FIG. 4). As shown in FIGS. 3 and 4, the meltblowing die 14 generally may include an extrusion slot 20 which receives the extrudable composition from the extruder 12. The extrudable composition then passes through the extrusion slot 20 and through a plurality of small diameter capillaries 22, which exit the die 14 in a linear arrangement, as shown in FIG. 2, extending across the tip 24 of the die 14, to emerge from the capillaries 22 as molten threads 26. Preferably, the extrudable composition is extrudable, within the above-defined temperature ranges, through the small diameter capillaries 22 at pressures, as applied by the turning screw of the extruder 12, of no more than about 300 psig. For example, in one embodiment, the extrudable composition may be extruded at a pressure of from about 20 psig to about 250 psig. In one embodiment, the composition may be extruded at a pressure of from about 50 psig to about 250 psig.

Generally speaking, the extrudable composition may be extruded through the capillaries 22 of the die 14 at a rate of from at least about 0.02 gram per capillary per minute to about 1.7 or more grams per capillary per minute, for example, from at least about 0.1 gram per capillary per minute to about 1.25 grams per capillary per minute. More specifically, from at least about 0.3 gram per capillary per minute to about 1.1 grams per capillary per minute.

Referring again to FIGS. 3 and 4, the die 14 also includes attenuating gas inlets 28 and 30 which are provided with heated, pressurized attenuating gas (not shown) by attenuating gas sources 32 and 34. The heated, pressurized attenuating gas enters the die 14 at the inlets 28 and 30 and follows the path generally designated by the arrows 36 and 38 through two chambers 40 and 42 and on through to narrow passageways or gaps 44 and 46 so as to contact the extruded threads 26 as they exit the capillaries 22 of the die 14. The chambers 40 and 42 are designed so that the heated attenuating gas exits the chambers 40 and 42 and passes through the gas passages 44 and 46 to form a stream (not shown) of attenuating gas which exits the die 14. The temperature and pressure of the heated stream of attenuating gas can vary widely. For example, the heated attenuating gas can be applied at a temperature of from about 100° C. to about 400° C., in one embodiment from about 200° C. to about 350° C. The heated attenuating gas can be applied at a pressure of from about 0.5 psig to about 20 psig, more specifically from about 1 psig to about 10 psig.

The position of air plates 48 and 50 which, in conjunction with a die-tip portion 52 of the die 14 define the chambers 40 and 42 and the passageways 44 and 46, may be adjusted relative to the die-top portion 52 to widen or narrow the width 54 of the attenuating gas passageways 44 and 46 so that the volume of attenuating gas passing through the air passageways 44 and 46 during a given time period can be varied without varying the velocity of the attenuating gas. Furthermore, in one embodiment the air plates 48 and 50 can also be adjusted upwardly and downwardly to effect a "recessed" die-tip configuration as shown in FIG. 3, or a protruding die-tip configuration as illustrated in FIG. 4. Generally speaking, it is preferred to utilize attenuating gas pressures of less than about 20 psig in conjunction with air passageway widths, which are usually the same, of no greater than about 0.20 inches. Lower attenuating gas velocities and wider air passageway gaps are generally preferred if substantially continuous microfibers are to be produced.

Referring again to FIG. 1, the two streams of attenuating gas converge to form a stream of gas which entrains and attenuates the molten threads 26, as they exit the linearly arranged capillaries 22, into fibers or, depending upon the degree of attenuation, microfibers (also designated 26) of a small diameter, to a diameter less than the diameter of the capillaries 22. Generally speaking, the attenuating gas may be applied to the molten threads 26 at a temperature of from at least about 100° C. to about 400° C. In one embodiment, from at least about 200° C. to about 350° C. and at pressures of from at least about 0.5 psig to about 20 psig or more. The gas-borne fibers 26 are blown, by the action of the attenuating gas, onto a collecting arrangement which, in the embodiment illustrated in FIG. 1, is a foraminous endless belt 56 conventionally driven by rollers 57.

In one embodiment, the substantially continuous fibers 26 may be formed and deposited on the surface of the belt 56. However, in alternative embodiments, the fibers 26 can be formed in a substantially discontinuous fashion by varying the velocity of the attenuating gas, the temperature of the attenuating gas and the volume of attenuating gas passing through the air passageways in a given time period. Other foraminous arrangements such as an endless belt arrangement may alternatively be utilized.

The belt 56 illustrated in FIG. 1 may also include one or more vacuum boxes (not shown) located below the surface of the foraminous belt 56 and between the rollers 57. In this embodiment, the fibers 26 are collected as a fibrous nonwoven elastomeric web 18 on the surface of the belt 56 which is rotating as indicated by the arrow 58 in FIG. 1. The vacuum boxes assist in retention of the fibers 26 on the surface of the belt 56. Typically the tip 24 of the die tip portion 52 of the meltblowing die 14 is from about 4 inches to about 24 inches from the surface of the foraminous endless belt 56 upon which the fibers 26 are collected. The deposited fibers 26 may then form a coherent, i.e. cohesive, fibrous nonwoven elastomeric web 18 which may be removed from the foraminous endless belt 56 by a pair of pinch rollers 60 and 62 which may be designed to press the entangled fibers of the web 18 together to improve the integrity of the web 18.

In one embodiment, the nonwoven web of the present invention can be a composite material such as, in one embodiment, a coform web which may include fibers and/or filaments formed from the thermoplastic elastic formulation of the present invention as well as discrete particles of one or more solid materials incorporated with the extruded threads 26 prior to their collection as a nonwoven elastomeric web 18. For example, it may be desirable to incorporate one or more fibers such as cotton fibers, wood pulp fibers, polyester fibers or other types of fibers or particulates into the threads 26. Blends of two or more of such fibers or particulates can also be incorporated. This may be accomplished by utilization of a coforming apparatus. Several types of coforming arrangements are well-known to those in the art. One embodiment of a possible coforming apparatus suitable for use in forming the elastic fibrous nonwoven webs of the present invention is illustrated schematically in FIG. 5 at 70.

Figure 5:
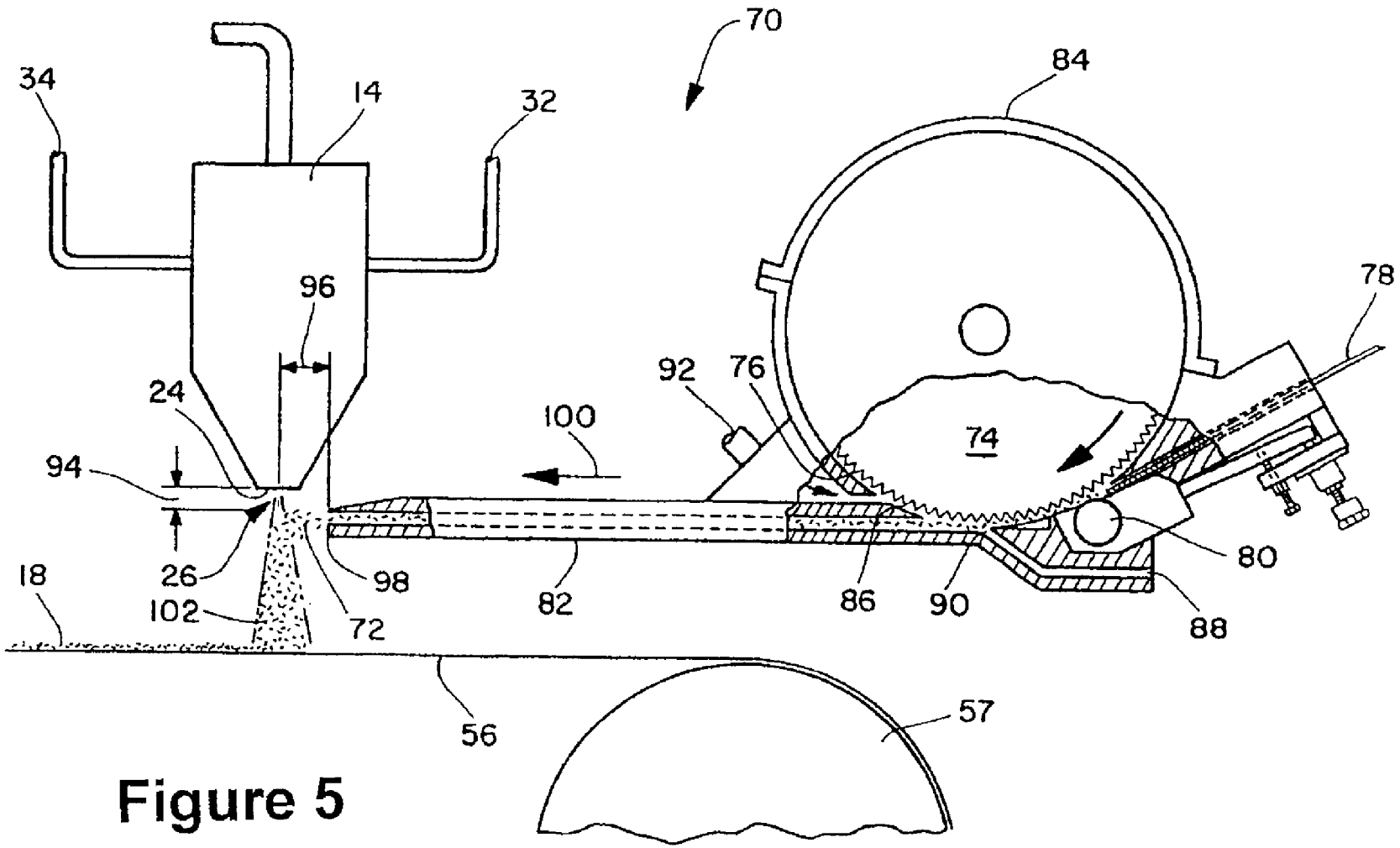
FIG. 5 is a schematic cross-sectional view with portions broken away for purposes of illustration of an arrangement which may be utilized to incorporate discrete particles, fibers or other materials into the extruded threads of molten material prior to their formation into a nonwoven web.

As illustrated in FIG. 5, after formation of the fibers 26, a stream of secondary fibers or particulates 72 may be generally uniformly injected into the stream of fibers 26. Distribution of the secondary fibers 72 generally uniformly throughout the stream of fibers 26 is accomplished in one embodiment by merging a secondary gas stream (not shown) containing the secondary fibers 72 with the stream of fibers 26. Apparatus for accomplishing this merger includes a conventional picker roll 74 which has a plurality of teeth 76 that are adapted to separate a matt or batt of secondary fibers 78 into the individual secondary fibers 72. The matt or batt of secondary fibers 78 which is fed to the picker roll 74 may be a sheet of pulp fibers (if a two component mixture of elastomeric fibers and pulp fibers is desired), a matt or batt of staple fibers (if a two component mixture of elastomeric fibers and staple fibers is desired) or both a sheet of pulp fibers and a matt or batt of staple fibers (if a three component mixture of elastomeric fibers, pulp fibers and staple fibers desired). Other combinations of one or more staple fibers and/or one or more pulp fibers may also be utilized.

The sheets or matts of secondary fibers 72 are fed to the picker roll 74 by a roller arrangement 80. After the teeth 76 of the picker roll 74 have separated the sheet or matt 78 into separate secondary fibers 72 the individual secondary fibers 72 are conveyed toward the meltblown stream of elastomeric fibers 26 through a forming duct or nozzle 82. A housing 84 encloses the picker roll 74 and provides a passageway or gap 86 between the housing 84 and the surface of the picker roll 74. A gas (not shown), preferably air, is supplied to the passageway or gap 86 between the surface of the picker roll 74 and the housing 84 by way of a gas duct 88. The gas duct 88 preferably enters the passageway or gap 86 generally at the junction 90 of the forming duct or nozzle 82 and the passageway 86. The gas is supplied in sufficient quantity to serve as a medium for conveying the secondary fibers 72 with the teeth 76 of the picker roll 74 and through the forming duct or nozzle 82 at a velocity approaching that of the teeth 76 of the picker roll 74.

As an aid in maintaining satisfactory secondary fiber 72 velocity, the forming duct or nozzle 82 may be positioned so that its longitudinal axis is substantially parallel to a plane which is tangent to the surface of the picker roll 74 at the junction 90 of the forming duct or nozzle 82 with the gap 86. As a result of this arrangement the velocity of the secondary fibers 72 is not substantially changed by contact of the secondary fibers 72 with the walls of the forming duct or nozzle 82. If the secondary fibers 72 remain in contact with the teeth 76 of the picker roll 74 after they have been separated from the matt or sheet 78, the axis of the forming duct or nozzle 82 may be adjusted appropriately to be aligned in the direction of secondary fiber 72 velocity at the point where the secondary fibers 72 disengage from the teeth 76 of the picker roll 74. If desired, the disengagement of the secondary fibers 72 with the teeth 76 of the picker roll 74 may be assisted by application of a pressurized gas, i.e., air, through duct 92.

The height 94 of the forming duct or nozzle 82 with respect to the die tip 24 may be adjusted to vary the properties of the coformed product. Variation of the distance 96 of the tip 98 of the nozzle 82 from the die tip 24 will also achieve variations in the final coformed product. The height 94 and distance 96 values will also vary with the material being added to the fibers 26. The width of the forming duct or nozzle 82 along the picker roll 74 and the length 100 that the forming duct or nozzle 82 extends from the picker roll 74 are also important in obtaining optimum distribution of the secondary fibers 72 throughout the stream of meltblown fibers 26. In general, the length 100 of the forming duct or nozzle 82 may be as short as equipment design will allow. The length 100 is usually limited to a minimum length which is generally equal to the radius of the picker roll 74. Preferably, the width of the forming duct or nozzle 82 should not exceed the width of the sheets or matts 78 that are being fed to the picker roll 74.

Though FIG. 5 illustrates that the gas stream carrying the secondary fibers 72 is moving in a direction which is generally perpendicular to the direction of movement of the stream of the fibers 26 at the point of merger of the two gas streams, other angles of merger of the two streams may be utilized. The velocity of the gas stream carrying the secondary fibers 72 is usually adjusted so that it is less than the velocity of the gas stream which attenuates the fibers 26. This allows the streams, upon merger and integration thereof, to flow in substantially the same direction as that of the stream of fibers 26. Indeed, the merger of the two streams is preferably accomplished in a manner which is somewhat like an aspirating effect whereby the stream of a secondary fiber 72 is drawn into the stream of fibers 26. In one embodiment, the velocity difference between the two gas streams will be such that the secondary fibers 72 are integrated into the fibers 26 in a turbulent manner so that the secondary fibers 72 become thoroughly mixed with the fibers 26. In general, increasing the velocity differential between the two streams produces a more homogeneous integration of the secondary fibers 72 into the fibers 26 and decreases in the velocity differential between the two streams are generally expected to produce concentrated areas of secondary fibers 72 within the fibers 26. Generally, for increased production rates, it is preferred for the gas stream which entrains and attenuates the stream of fibers 26 to have an initial high velocity, for example from about 200 to about 1,000 feet per second and for the stream of gas which carries the secondary fibers 72 to have an initial low velocity, for example from about 50 to about 200 feet per second. Of course, after the stream of gas that entrains and attenuates the extruded threads 26 into elastomeric microfibers exits the air passageways 44 and 46 of the meltblowing die 14 it immediately expands and decreases in velocity.

Upon merger and integration of the stream of secondary fibers 72 into the stream of fibers 26 to generally uniformly distribute the secondary fibers 72 throughout the stream of meltblown fibers 26, as discussed above, a composite stream 102 of fibers 26 and secondary fibers 72 is formed. The fibers 26 may still be semi-molten and tacky at the time of incorporation of the secondary fibers 72 into the fibers 26, and, in such a situation, the secondary fibers 72 are not only mechanically entangled within the fibers 26 but also usually become thermally bonded to the fibers 26. However, if the fibers 26 are not semi-molten and tacky at the time of incorporation of the secondary fibers 72 therein, the secondary fibers 72 will only be mechanically entangled within the fibers 26.

In order to convert the composite stream 102 of fibers 26 and secondary fibers 72 into a fibrous nonwoven elastomeric web 18 of elastomeric fibers 26 having the secondary fibers 72 generally uniformly distributed throughout and, if desired, bonded to the fibers 26 of the web 18, a collecting device is located in the path of the composite stream 102. The collecting device may be a rotating belt 56 as described with respect to FIG. 1 upon which the composite stream 102 impacts to form the web 18. Preferably, the external surface of the rotating belt 56 is porous and the rotating belt 56 includes a conventional vacuum arrangement (not shown) which assists in retaining the composite stream 102 on the external surface of the belt 56. Other collecting devices are well known to those of skill in the art and may be utilized in place of the rotating belt 56, for example, a porous rotating drum arrangement could be utilized. Thereafter, the web 18 may be removed from the belt 56 by a pair of nip rollers (now shown) in an arrangement equivalent to that illustrated in FIG. 1.

Depending on the characteristics desired of the coformed fibrous nonwoven elastomeric web, the web may include from at least about 20%, by weight, of a the elastic material of the present invention. Additionally, the secondary fibers can form from about 30%, by weight, to about 70%, by weight, of the coformed web. In one embodiment, the secondary fibers can form from about 50%, by weight, to about 70%, by weight, of the coformed web.

In one embodiment, the picker roll 74 may be replaced by a conventional particulate injection system to form a fibrous nonwoven elastomeric web 18 containing various particulates. A combination of both coformed fibers and particulates could be added to the fibers 26 prior to their formation into a fibrous nonwoven elastomeric web 18.

Figure 10:
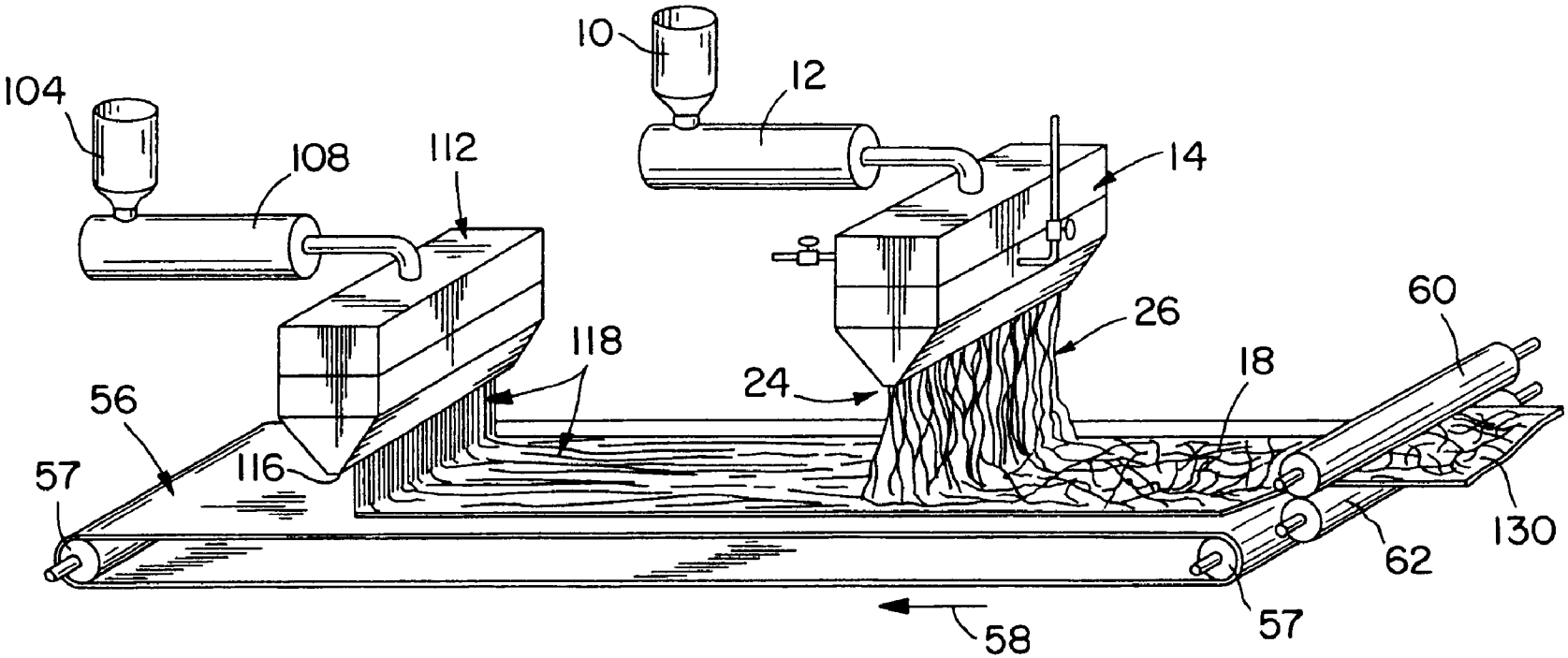
FIG. 10 is a schematic drawing of an exemplary process for forming an anisotropic elastic fibrous web according to the present invention.

In another embodiment, the elastic web of the present invention may be a multi-layer web. FIG. 10 is a schematic view of a process for forming an anisotropic, multi-layer elastic fibrous web which may be used as a component of a composite elastic material. In forming the fibers and the filaments which are used in the anisotropic elastic fibrous web, pellets or chips, etc. (not shown) of an extrudable elastomeric polymer are introduced into a pellet hoppers 10 and 104 of extruders 12 and 108.

Each extruder has an extrusion screw (not shown) which is driven by a conventional drive motor (not shown). As the polymer advances through the extruder, due to rotation of the extrusion screw by the drive motor, it is progressively heated to a molten state. Heating the polymer to the molten state may be accomplished in a plurality of discrete steps with its temperature being gradually elevated as it advances through discrete heating zones of the extruder 12 toward a meltblowing die 14 (similar to that illustrated in FIG. 1) and extruder 108 toward a continuous filament forming means 112. The meltblowing die 14 and the continuous filament forming means 112 may be yet another heating zone where the temperature of the thermoplastic resin is maintained at an elevated level for extrusion. Heating of the various zones of the extruders 12 and 108 and the meltblowing die 14 and the continuous filament forming means 112 may be achieved by any of a variety of conventional heating arrangements (not shown).

The elastomeric filament component of the anisotropic elastic fibrous web may be formed utilizing a variety of extrusion techniques. For example, the elastic filaments may be formed utilizing one or more conventional meltblowing die arrangements which have been modified to remove the heated gas stream (i.e., the primary air stream) which flows generally in the same direction as that of the extruded threads to attenuate the extruded threads. This modified meltblowing die arrangement 112 usually extends across a foraminous collecting belt 56 in a direction which is substantially transverse to the direction of movement of the collecting surface 56. The modified die arrangement 112 includes a linear array 116 of small diameter capillaries aligned along the transverse extent of the die with the transverse extent of the die being approximately as long as the desired width of the parallel rows of elastomeric filaments which is to be produced. That is, the transverse dimension of the die is the dimension which is defined by the linear array of die capillaries. Typically, the diameter of the capillaries will be on the order of from about 0.01 inches to about 0.02 inches, for example, from about 0.0145 to about 0.018 inches. From about 5 to about 50 such capillaries will be provided per linear inch of die face. Typically, the length of the capillaries will be from about 0.05 inches to about 0.20 inches, for example, about 0.113 inches to about 0.14 inches long. A meltblowing die can extend from about 20 inches to about 60 or more inches in length in the transverse direction.

Since the heated gas stream (i.e., the primary air stream) which flows past the die tip is greatly reduced or absent, it is desirable to insulate the die tip or provide heating elements to ensure that the extruded polymer remains molten and flowable while in the die tip. Polymer is extruded from the array 116 of capillaries in the modified die 112 to create extruded elastomeric filaments 118.

The extruded elastomeric filaments 118 have an initial velocity as they leave the array 116 of capillaries in the modified die 112. These filaments 118 are deposited upon a foraminous surface 56 which should be moving at least at the same velocity as the initial velocity of the elastic filaments 118. This foraminous surface 56 is an endless belt conventionally driven by rollers 57. The filaments 118 are deposited in substantially parallel alignment on the surface of the endless belt 56 which is rotating as indicated by the arrow 58. Vacuum boxes (not shown) may be used to assist in retention of the matrix on the surface of the belt 56. The tip of the die 112 is should be as close as practical to the surface of the foraminous belt 56 upon which the continuous elastic filaments 118 are collected. For example, this forming distance may be from about 2 inches to about 10 inches. Desirably, this distance is from about 2 inches to about 8 inches.

It may be desirable to have the foraminous surface 56 moving at a speed that is much greater than the initial velocity of the elastic filaments 118 in order to enhance the alignment of the filaments 118 into substantially parallel rows and/or elongate the filaments 118 so they achieve a desired diameter. For example, alignment of the elastomeric filaments 118 may be enhanced by having the foraminous surface 56 move at a velocity from about 2 to about 10 times greater than the initial velocity of the elastomeric filaments 118. Even greater speed differentials may be used if desired. While different factors will affect the particular choice of velocity for the foraminous surface 56, it will typically be from about four to about eight times faster than the initial velocity of the elastomeric filaments 118.

Desirably, the continuous elastomeric filaments are formed at a density per inch of width of material which corresponds generally to the density of capillaries on the die face. For example, the filament density per inch of width of material may range from about 10 to about 120 such filaments per inch width of material. Typically, lower densities of filaments (e.g., 10-35 filaments per inch of width) may be achieved with only one filament forming die. Higher densities (e.g., 35-120 filaments per inch of width) may be achieved with multiple banks of filament forming equipment.

A meltblown fiber component 18 of the anisotropic web may then be formed and deposited on the elastomeric filaments 118 in a manner similar to that described by FIG. 1, above. The product anisotropic web, 130, may contain at least about 20% by weight elastomeric filaments. In one embodiment, the anisotropic web 130, may contain from about 20% to about 80% by weight elastomeric filaments.

The low basis weight elastic webs of the present invention may have a basis weight ranging from about 5 grams per square meter to about 200 grams per square meter while displaying excellent elastic characteristics. In one embodiment, the elastic webs or films of the present invention may have a basis weight ranging from about 5 grams per square meter to about 100 grams per square meter, for example, less than about 16 grams per square meter. In one embodiment, the elastic webs or films of the present invention may have a basis weight of less than about 12 grams per square meter. In one embodiment, the elastic webs or films may display a tension of at least about 450 grams force at an elongation of 50% greater than the non-elongated length of the web.

In one embodiment, the present invention is directed to composite laminate structures including at least one layer of the elastic webs herein disclosed. In general, the individual layers of the composite laminate structures of the present invention may be adhesively bonded one to another. For example, the layers of the laminate structure may be adhesively bonded by use of a spray adhesive with sufficient bonding strength to form an elastic laminate structure which may be stretched and relaxed to provide the desired degree of elasticity. The composite laminate elastic materials of the present invention may be either stretch-bonded laminate materials or neck-bonded laminate materials.

The web or webs to which one or more of the elastic webs are bonded may themselves be elastic or, more usually, may comprise one or more non-elastic webs. Generally, elastic materials such as elastic fibrous webs have a rubbery feel and in applications where the feel of the composite material is of importance, a non-elastic web such as a bonded carded nonelastic polyester or nonelastic polypropylene fiber web, a spunbonded nonelastic polyester or polypropylene nonelastic fiber web, nonelastic cellulosic fiber webs, e.g., cotton fiber webs, polyamide fiber webs, e.g., nylon 6-6 webs sold under the trademark Cerex by Monsanto, and blends of two or more of the foregoing may be utilized. Generally, woven and nonwoven webs of any textile or other material suitable for the purpose may be used. However, relatively inexpensive and attractive composite fabrics with good hand and feel and with good stretchability and recovery characteristics have been attained by bonding to one or both sides of an elastic web (such as a fibrous elastic web) a bonded carded polyester web, a spunbonded polypropylene fiber web, and single and multilayer combinations thereof.

In certain embodiments of the present invention the individual layers of the present invention can display improved compatibility toward each other. More specifically, it is believed that the polyolefin wax utilized in the elastic formulation, in addition to increasing the modulus of the elastic web, may also improve the compatibility of the elastic material to other polyolefin-based materials, such as nonwoven polyolefin facing materials, for example, when forming composite elastic laminates.

The compatibility between adjacent layers of the composite laminate material can be examined via the differences in solubility parameters of the materials forming the layers as well as via the tendency of the materials to develop higher levels of crystallinity. For example, the solubility parameters of polypropylene is in the range of about 7.2 to about 7.4 $(cal/cm)^{0.5}$, while the solubility parameters of polypropylene is in the range of about 9.2 to about 9.4 $(cal/cm)^{0.5}$. As such, in those embodiments wherein both the elastic web and the adjacent web of the laminate include the same polyolefin, the adjacent layers may be more compatible with each other and display improved bonding as compared to when the adjacent layers contain different materials, e.g., when the elastic laminate includes an elastic web comprising a polyethylene wax and the adjacent layer of the laminate is a nonwoven polypropylene web. Hence, if a nonwoven facing is based on polyethylene, the polyolefin wax of choice for the thermoplastic elastomeric formulation may be a low molecular weight polyethylene.

In one embodiment of the present invention, the elastic web may be laminated to a nonwoven web which contains both polyethylene and polypropylene. For example, the elastic web may be combined with a nonwoven web formed of copolymerized polyethylene and polypropylene, bicomponent polyethylene/polypropylene fibers, such as side by side bicomponent fibers, or a coform nonwoven web comprising both polyethylene fibers and polypropylene fibers. In such an embodiment, both a polyethylene wax and a polypropylene wax may be included in the elastomeric formulation, so as to further improve compatibility between the adjacent layers in the bonded laminate.

In one embodiment, the composite elastic laminate structures of the present invention may be either neck-bonded or stretch-bonded laminate materials. As used herein, the term "neck-bonded" refers to an elastic member being bonded to a non-elastic member while the non-elastic member is extended in the machine direction creating a necked material. "Neck-bonded laminate" refers to a composite material having at least two layers in which one layer is a necked, non-elastic layer and the other layer is an elastic layer thereby creating a material that is elastic in the cross direction. Examples of neck-bonded laminates are such as those described in U.S. Pat. Nos. 5,226,992, 4,981,747, 4,965,122, and 5,336,545, all to Morman, which are incorporated herein by reference thereto as to all relevant material.

As used herein, the term "stretch-bonded" refers to a composite material having at least two layers in which one layer is a gatherable layer and the other layer is an elastic layer. The layers are joined together when the elastic layer is in an extended condition so that upon relaxing the layers, the gatherable layer is gathered. For example, one elastic member can be bonded to another member while the elastic member is extended at least about 25 percent of its relaxed length. The resultant composite laminate material may then itself be elastic, since its non-elastic layers will be able to move with the stretching of the elastic layer by reason of the play or give provided by the gathers formed in the non-elastic layers during the bonding of the layers. One type of stretch-bonded laminate is disclosed, for example, in U.S. Pat. No. 4,720,415 to Vander Wielen et al., which is incorporated herein by reference as to all relevant material.

The layers of the composite laminate structures of the present invention may be adhesively bonded together without the addition of heat. The use of adhesive bonding is generally preferred in the laminate structure in order to prevent stretching, thinning, or other damage to the individual layers. Such damage may lead to areas of weakness in the laminate and possible breaks or ruptures forming in the laminate materials under expected use conditions.

Any suitable adhesives which do not require elevated temperatures in order to form a bond may be utilized in the present invention. For example, in one embodiment, spray adhesives such as 2525A or 2096, both available from Findley Adhesives may be used.

Latex materials may also serve as the adhesive joining two layers in the laminate structure of the present invention. Examples of latex adhesives include latex 8085 from Findley Adhesives. The latex referred to for any purpose in the present specification may be any latex, synthetic latex (e.g., a cationic or anionic latex), or natural latex or derivatives thereof.

Figure 6:
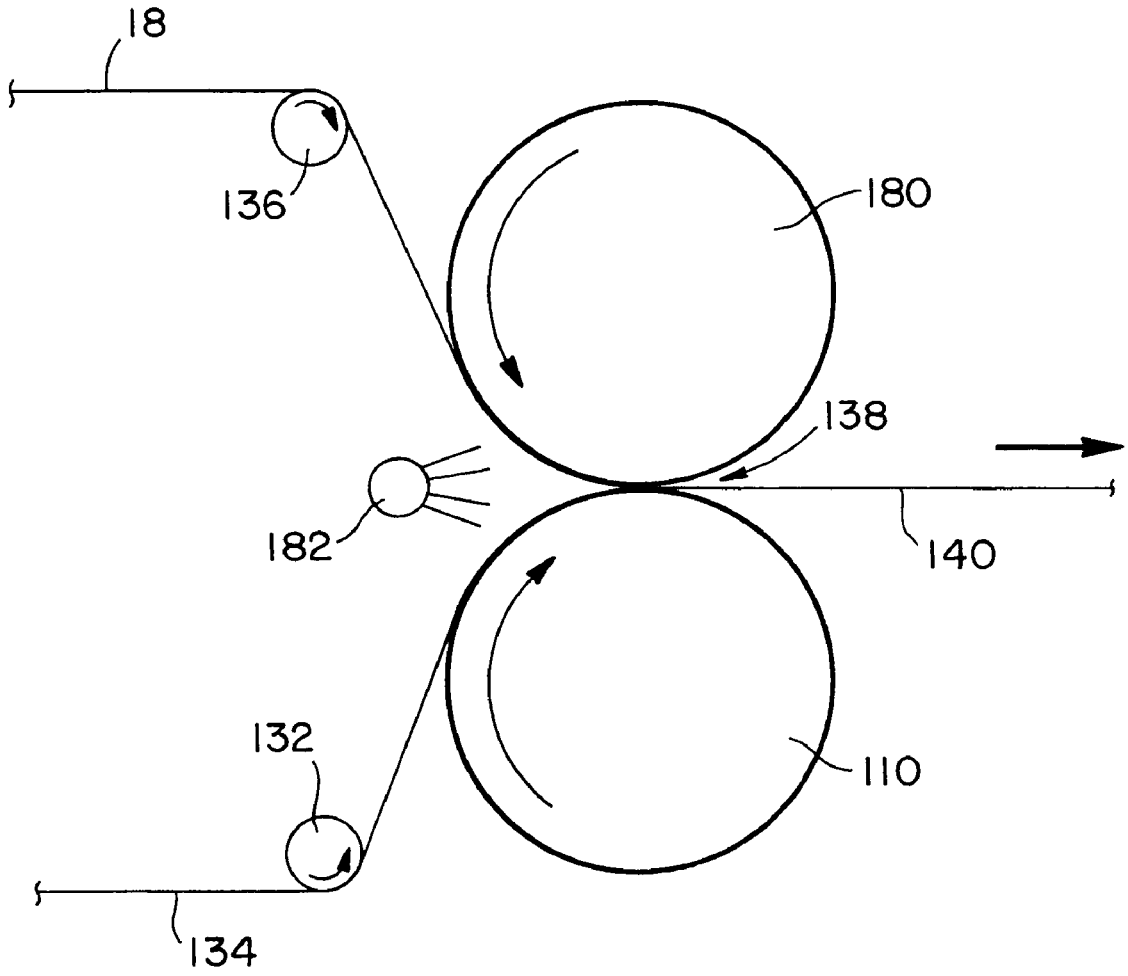
FIG. 6 is an embodiment of a process for combining the layers of the composite laminate construction of the present invention.

The layers of the laminate composite material may be adhesively bonded in any suitable fashion. For example, one possible embodiment for a method of adhesively bonding an elastic web with another layer to form an elastic composite laminate is illustrated in FIG. 6. As can be seen in the figure, an elastic web 18 and a second web 134 may be brought together after formation by use of guide rolls 132 and 136, and an adhesive 182 may be applied to one or both layers prior to or at contact between the layers which may bond the layers of the laminate material together. For example, the layers may be brought together in a nip 138, between rolls 110 and 180 to form an adhesively bonded laminate construction 140. In this embodiment, the layers may be attached through utilization of the adhesive alone, or optionally, pressure may also be applied in the nip 132 as the layers are brought together, to further enhance the bond between the layers. An adhesive may be applied to one or both of the layers of the laminate material by any method. For example, in addition to a spray method, as illustrated in FIG. 6, an adhesive may be applied through any known printing, coating, or other suitable transfer method. In one embodiment, the basis weight of the adhesive may be about 1 gsm or greater, such as from about 2 gsm to about 50 gsm, more specifically about 2 gsm to about 10 gsm. Alternatively, the basis weight of the added adhesive may be less than about 5 gsm.

The laminate structures of the present invention may include 2, 3, 4 or even more individual layers. For example, the laminate structure may include a single elastic web sandwiched between two other non-elastic facing layers. In another embodiment, the laminate material may include an elastic film which may serve as an outer layer of a laminate structure and one or more additional layers (which may include additional elastic webs) bonded to one side of the elastic film. Any other combination of webs in a laminate structure is encompassed by the present invention.

The laminate structures of the present invention may be utilized generally in any article calling for elastic materials. For example, the laminate structure may be converted and included in many different products, such as various personal care products. Products which may utilize the novel laminate structures may include, for example, stretchable protective covers and wraps, outerwear, undergarments, feminine hygiene pads, incontinence control pads, and disposable garments including incontinence garments, disposable diapers, training pants, and the like.

Reference now will be made to varidus embodiments of the invention, one or more examples of which are set forth below. Each example is provided by way of explanation of the invention, not as a limitation of the invention. In fact, it will be apparent to those skilled in the art that various modifications and variations may be made of this invention without departing from the scope or spirit of the invention.

Testing Methods

Elastic Basis Weight

This test was used to determine the basis weight of the elastic in the laminates prepared. The stretch to stop value was obtained by stretching a 3"×7" sample at a rate of 20" per minute to determine the percent elongation at 2000 grams-force (stop). The stretch to stop value, along with the laminate basis weight, was used to calculate the elastic basis weight as the strands are entered into the calendar. Normalized loads are calculated by taking the load at a given elongation and dividing by the elastic basis weight in the calendar. This test determines load response per unit elastic basis weight of the material or tensile efficiency.

Rheology

The capillary rheometer used for the measurements of viscosity as a function of shear rates was the Rheometrics Acer 2000 (Advanced Capillary Extrusion Rheometer). Various polymers were tested at shear rates ranging from 10 to 10,000 1/s. The barrel diameter was 20.0 mm and length was 300.0 mm, and the diameter of the die used was 1.0 mm.

The procedure for performing rheology testing using the Acer 2000 is as follows: First, the barrel is flushed out by extruding the polymer to be tested. After extruding an entire polymer sample, the barrel is then reloaded and the polymer is allowed to soak. The soaking allows the polymer and barrel to reach equilibrium with the testing temperature. After this step is completed, the shear rates of interest are pre-set and the equipment is ready to collect data. As the force equilibrates, the shear rate automatically changes to the next pre-set rate, and the viscosity for each rate is recorded. A graph reporting the viscosity as a function of shear rate was then generated.

Stress-Elongation

All stress-elongation mechanical tests of the polymers and laminates were performed using a Sintech 1/s frame. The film samples used were cut using a Type I "dog bone" die, specified in ASTM D638 tensile test method. The sample was clamped into the jaws of a Sintech 1/S testing frame, set at a 2" grip-to-grip distance. The displacement of the crosshead was set at a speed of 2"/min. The film samples were stretched to failure. A 3"×7" laminate specimen was used to determine their stress elongation behavior. The crosshead speed was set at 20"/min. The laminate samples were stretched to 2000 grams at room temperature (about 20° C.). The stress and elongation were calculated using knowledge of the initial length final length and width of the laminate.

Stress Relaxation

The stress relaxation testing was executed using the Instron 1122 test frame equipped with an environmental chamber. The environmental chamber was set at 100° F. to represent body temperature. The material was then stretched to a length of 4.76 inches (58.7% elongation). A 3"×7" specimen was clamped into jaws set at a 3-inch grip-to-grip distance. The load loss at body temperature was then measured for 12 hours. The slope and load loss are calculated and reported.

EXAMPLE 1

The elastomeric polymers used in these examples were obtained in pellet form or were converted to pellets before conversion. All polymers were composed of triblock or tetrablock backbone structure.

Elastomeric polymer formulations were prepared as shown below in Table 1, which includes an identification number, components present, and the composition of the formulations.

TABLE 1

| Sample ID | Elastomeric polymer | Regalrez ® Tackifier | % Polyethylene wax NA 601-00 |
|---|---|---|---|
| 1 | 100% S-EP-S-EP | 0% | 0% |
| 2 | 68% S-EP-S-EP | 20% | 12% |
| 3 | 85% S-EP-S-EP | 0% | 15% |
| 4 | 80% S-EP-S-EP | 0% | 20% |
| 5 | 70% S-EP-S-EP | 0% | 30% |
| 6 | 70% S-EB-S | 0% | 30% |
| 7 | 63% S-EB-S/S-EB | 17% | 20% |

Figure 7:
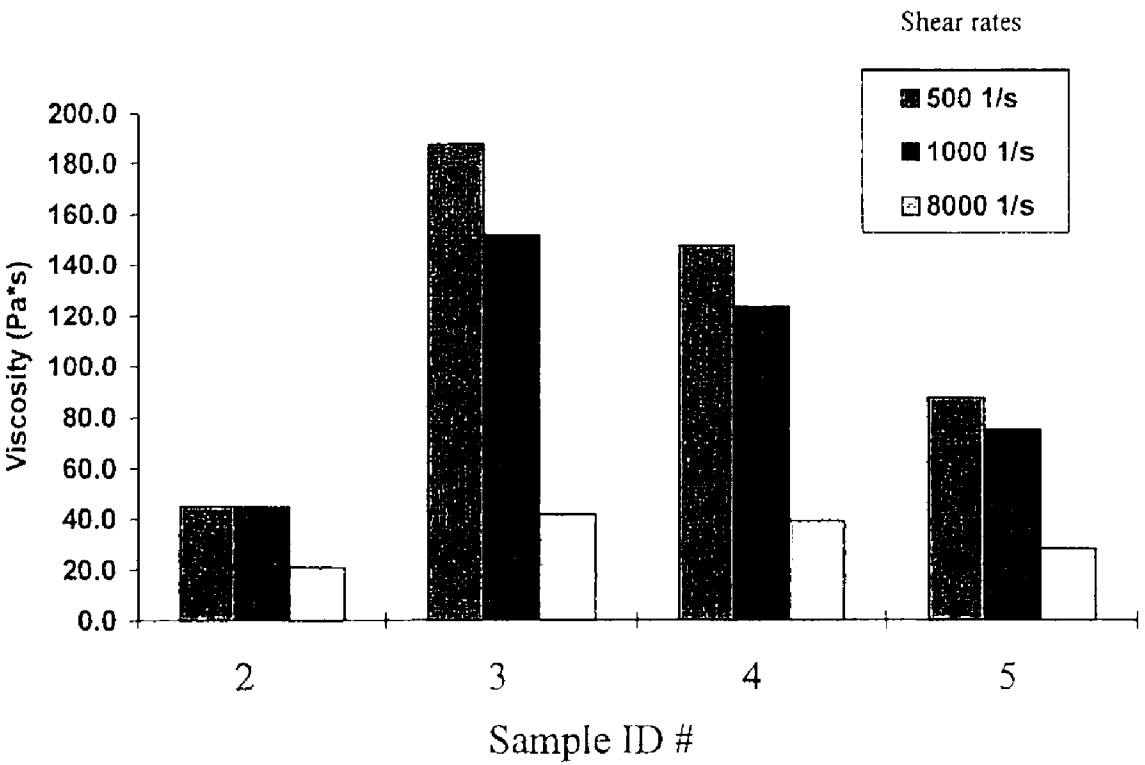
FIG. 7 is a graph depicting viscosities of the materials of the present invention at various shear rates.

FIG. 7 graphically illustrates the viscosity obtained for four of the samples at various shear rates. As can be seen from the figure, the removal of tackifier increases the viscosity but increasing the concentration of wax decreases the viscosity. At suitably high shear rates, the viscosities of the polymer formulations of the present invention are comparable to those of formulations which also include a tackifier. As such, these tackifier-free blends are suitable for use in any standard process facility.

EXAMPLE 2

Stretch-bonded laminates were prepared including elastic webs composed of the elastomeric polymer formulations described in Example 1, above. The laminates included an elastomeric web according to the present invention bonded to either one or two spunbond facings. Table 2 shows the elastomer basis weights in the calendar (i.e., in the stretched state as opposed to the relaxed state), including standard deviation, for the laminates. The values shown are an average of at least 5 to 12 samples.

In forming the elastic webs used in the laminates, the elastomeric polymer formulations were added into the pellet hoppers of two extruders and an anisotropic elastomeric web was formed including a layer of substantially parallel rows of elastomeric filaments autogenously bonded to a layer of elastomeric meltblown fibers, as described herein and illustrated in FIG. 10. A variety of throughput rates, temperatures, and extruder rates were used depending on the rheological properties of each polymer with a target web of approximately the same tension values for all of the laminates at 50% elongation. The laminates were composed of anisotropic elastic webs formed from the elastomeric polymers used in Example 1, either one or two spunbond facings, and a spray adhesive, which was used on one or both sides of the materials. The spray adhesive used was the Findley 2525A adhesive.

TABLE 2

| Sample ID # | Elastomeric Polymer | Poly./wax/ Tack. Composition (Rubber) | Adhesive Appli-cation on Facing | Stretch To Stop (± std. dev.) | Elastic Basis wt. at the nip ± std. dev. |
|---|---|---|---|---|---|
| 8 | S-EP-S-EP | 80/20/0 | 1 side | 153 ± 11 | 15 ± 3 |
| 9 | S-EP-S-EP | 80/20/0 | 2 sides | 154 ± 1 | 14 ± 2 |
| 10 | S-EP-S-EP | 85/15/0 | 1 side | 170 ± 13 | 15 ± 1 |
| 11 | S-EP-S-EP | 70/30/0 | 1 side | 141 ± 4 | 12 ± 2 |
| 12 | S-EP-S-EP | 68/12/20 | 1 side | 141 ± 10 | 27 ± 1 |
| 13 | S-EP-S-EP | 68/12/20 | 2 sides | 153 ± 10 | 24 ± 2 |
| 14 | S-EP-S-EP | 100/0/0 | 1 side | 172 ± 7 | 9 ± 3 |
| 15 | S-EP-S-EP | 100/0/0 | 2 sides | 168 ± 16 | 11 ± 2 |
| 16 | S-EB-S | 70/30/0 | 2 sides | 143 ± 4 | 9 ± 1 |

As can be seen from the table, within the given standard deviations, the application of adhesive on both sides of the facings had negligible effect on all properties measured and calculated.

Comparison of the stretch to stop (STS) values given in the table prompts the following conclusions for the tackifier-free polymer formulations:

An increase in the level of wax in the formulations decreases the stretch to stop of the laminate. However, the actual value of the stretch to stop ratio is higher for the experimental polymers than the control containing wax and tackifier. The base polymer S-EP-S-EP gives the highest STS.

The 70/30 S-EB-S polymer shows similar behavior as S-EP-S-EP polymer with respect to the stretch to stop behavior.

FIG. 8 shows the normalized load, with respect to the basis weight of the elastomer in the laminate, as a function of percentage elongation at room temperature (about 20° C.). It can be seen from the figure that the 70/30 composition (Sample ID # 11) gives the highest load-elongation response. This illustrates the reinforcing ability of the wax. The 85:15 (Sample ID # 10) and 80:20 (Sample ID # 8) compositions behave in an essentially identical manner. However, the control containing tackifier and wax (Sample ID # 12) gives the lowest load response for any elongation. This illustrates the negative impact of tackifier as a reinforcer. At 50 to 60% elongation, clearly the tackifier free S-EP-S-EP polymers deliver better load response than the control (S-EP-S-EP) containing wax and tackifier.

FIG. 9 shows the normalized load, with respect to the basis weight of the elastomer in the laminate, as a function of percentage elongation at body temperature (about 37° C.). As can be seen, similar to the responses at room temperature, shown in FIG. 8, the load loss is proportional and the 70/30 formulation still maintains its higher load response for a given elongation.

Figure 11:
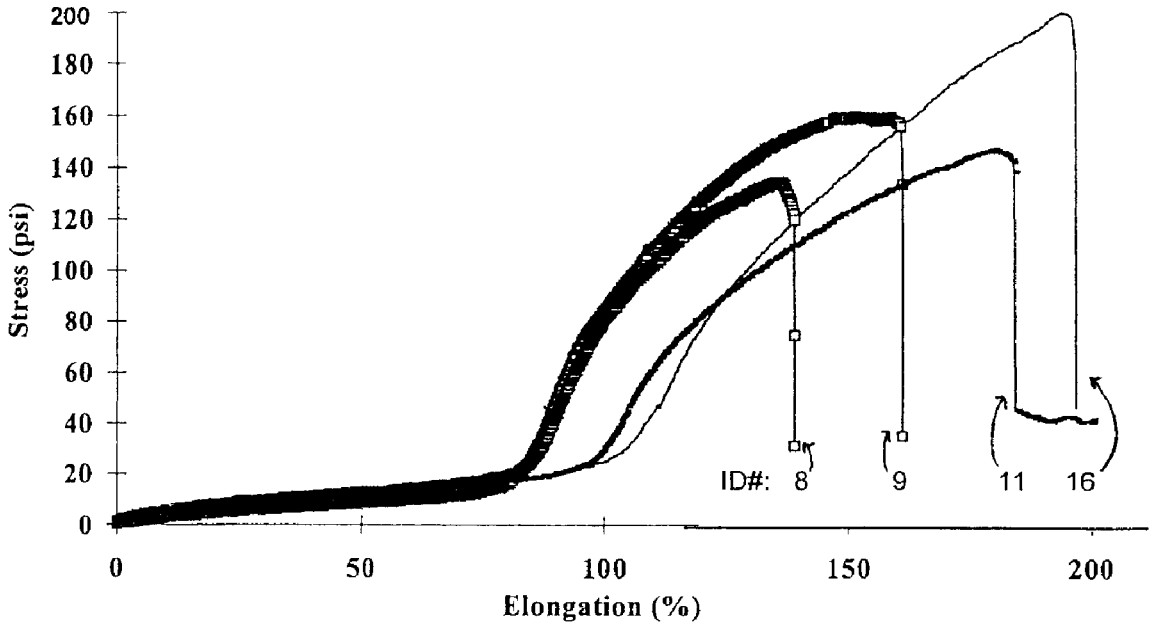
FIG. 11 is a graph depicting stress as a function of elongation for laminate structures of the present invention.

FIG. 11 gives a schematic illustration of the stress-elongation behavior of some of the laminates. Specifically, FIG. 11 illustrates the stress-elongation behavior of Sample ID numbers 8, 9, 11 and 16 as described in Table 2, above. It can be seen from FIG. 10 that the initial modulus of the laminates calculated for the blends using rubber elasticity theory are the same, within the experimental error, and that the loads at 50% elongation are comparable to each other. The formulation including the S-EB-S tri-block copolymer and 30% wax with no tackifier (Sample ID No.16) added gives the best stress-elongation behavior.

Figure 12:
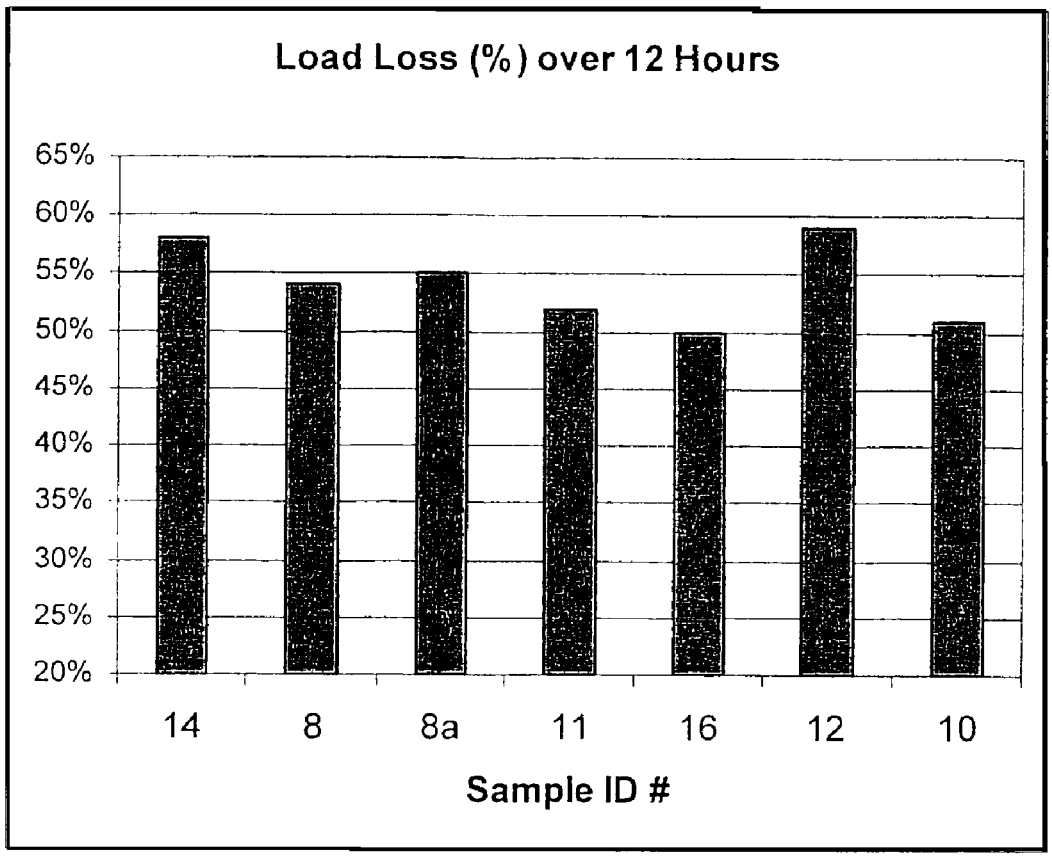
FIGS. 12 and 13 are graphs depicting load loss over time and slope of the load loss over time for laminate structures of the present invention.
Figure 13:
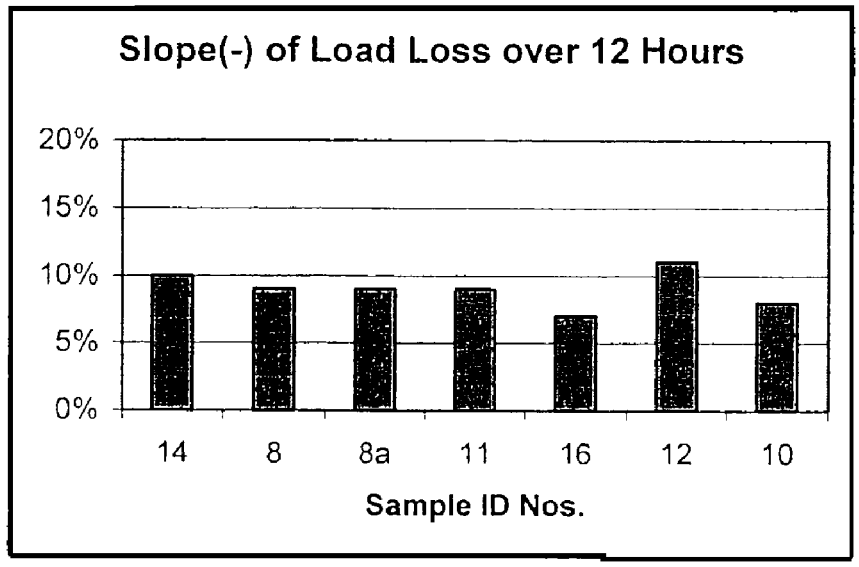

Table 3, below, gives the 12-hour body temperature load loss and slope of the load loss curve over time of various laminates studied. The load loss and slope figures for the laminates has been found to be essentially the same as the load loss and slope values for the elastic web from which the laminates are made. This invariant behavior of these materials' parameters suggests that the process of converting the polymer into a composite (laminate) material does not introduce any additional loss of elasticity. It can be seen from the table that the 100% tetra-block base polymer (Sample ID # 14) loses about 58% of the initial load and has a negative slope of 0.10. It can also be seen that the magnitude of the load loss and stress relaxation values of 80/20 (Sample ID Nos. 8 and 8a, which is a second laminate prepared according to the conditions shown for Sample ID No. 8) and 70/30 (Sample ID No. 11) tetrablock and wax containing polymers are at parity or slightly lower than the control sample (Sample ID No. 12). The addition of tackifier increases the slope slightly. However, the 85/15 blend (Sample ID # 10) gives a lower load loss of 51% and a negative slope 0.08 respectively. The 70/30 S-EB-S/wax polymer laminate (Sample ID No. 16) displays very good elastic characteristics, with a load loss of only 50%, and a negative slope of just 0.07. FIGS. 12 and 13 illustrate bar graphs of the data presented in Table 3.

TABLE 3

| Sample ID # | Load Loss (%) | Slope |
|---|---|---|
| 14 | 58 | −0.10 |
| 8 | 54 | −0.09 |
| 8a | 55 | −0.09 |
| 11 | 52 | −0.09 |
| 16 | 50 | −0.07 |
| 12 | 59 | −0.11 |
| 10 | 51 | −0.08 |

It will be appreciated that the foregoing examples, given for purposes of illustration, are not to be construed as limiting the scope of this invention. Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention, which is defined in the following claims and all equivalents thereto. Further, it is recognized that many embodiments may be conceived that do not achieve all of the advantages of some embodiments, yet the absence of a particular advantage shall not be construed to necessarily mean that such an embodiment is outside the scope of the present invention.

What is claimed:

1. An elastic laminate structure comprising:

an elastic web consisting of a triblock copolymer and a greater than 0% and less than about 50% by weight of a polyolefin wax, wherein the triblock copolymer comprises a block copolymer selected from the group consisting of a polystyrene/poly(ethylene-propylene)/polystyrene block copolymer and a polystyrene/poly (ethylene-butylene)/polystyrene block; and a second web adhesively secured to the elastic web, wherein the second web comprises polyolefin fibers, and wherein the polyolefin fibers and the polyolefin wax comprise the same polyolefin.

2. The elastic laminate structure of claim 1, wherein the elastic web has a basis weight less than about 16 grams per square meter.

3. The elastic laminate structure of claim 1, wherein the elastic web exhibits at least about 450 grams-force tension when the elastic web is elongated by about 50% of its non-stretched length.

4. The elastic laminate structure of claim 1, wherein the second web is adhesively secured to the elastic web with a spray adhesive other than a hot melt adhesive.

5. The elastic laminate structure of claim 1, wherein the second web comprises a nonwoven web.

6. The elastic laminate structure of claim 5, wherein the second web comprises a meltblown or spunbond nonwoven web.

7. The elastic laminate structure of claim 6, wherein the polyolefin fibers are selected from the group consisting of polyethylene fibers, polypropylene fibers, and mixtures thereof.

8. The elastic laminate structure of claim 6, wherein the polyolefin fibers comprise bicomponent fibers.

9. The elastic laminate structure of claim 1, wherein the elastic laminate structure is a stretch-bonded laminate.

10. The elastic laminate structure of claim 1, wherein the elastic laminate structure is a neck-bonded laminate.

11. The elastic laminate structure of claim 1, wherein the elastic web is selected from the group consisting of a meltblown web, a spunbond web, an anisotropic web, and a film.

12. The elastic laminate structure of claim 1, wherein the elastic web comprises filaments.

13. The elastic laminate structure of claim 1, wherein the laminate structure further comprises at least one additional layer.

14. An elastic laminate structure comprising:

an elastic web consisting of greater than 0% and less than about 50% by weight of a polyolefin wax and a polystyrene/poly(ethylene-butylene)/polystyrene block copolymer; and a second web adhesively secured to the elastic web, wherein the second web comprises polyolefin fibers, and wherein the polyolefin fibers and the polyolefin wax comprise the same polyolefin.

15. An elastic laminate structure comprising:

an elastic web consisting of a triblock copolymer selected from the group consisting of a polystyrene/poly(ethylene-propylene)/polystyrene block copolymer and a polystyrene/poly(ethylene-butylene)/polystyrene block; wherein the elastic web further comprises greater than 0% and less than about 50% by weight of a polyolefin wax;

a second web comprising polyolefin fibers, wherein the polyolefin fibers and the polyolefin wax comprise the same polyolefin; and a spray adhesive between the elastic web and second web adhesively securing the elastic web and the second web together.

16. The elastic laminate structure of claim 15, wherein the second web comprises a nonwoven web.

17. The elastic laminate structure of claim 16, wherein the second web comprises a meltblown or spunbond nonwoven web.

18. The elastic laminate structure of claim 17, wherein said polyolefin fibers are selected from the group consisting of polyethylene fibers, polypropylene fibers, and mixtures thereof.

19. The elastic laminate structure of claim 17, wherein the polyolefin fibers comprise bicomponent fibers.

20. The elastic laminate structure of claim 15, wherein the elastic laminate structure is a stretch-bonded laminate.

21. The elastic laminate structure of claim 15, wherein the elastic laminate structure is a neck-bonded laminate.

22. The elastic laminate structure of claim 15, wherein the elastic web is selected from the group consisting of a meltblown web, a spunbond web, an anisotropic web, and a film.

23. The elastic laminate structure of claim 15, wherein the elastic web comprises filaments.

24. The elastic laminate structure of claim 15, wherein the laminate structure further comprises at least one additional layer.

25. An elastic laminate structure comprising:

an elastic web consisting of greater than 0% and less than about 50% by weight of a polyolefin wax and a polystyrene/poly(ethylene-butylene)/polystyrene block copolymer;

a second web comprising polyolefin fibers, wherein the polyolefin fibers and the polyolefin wax comprise the same polyolefin; and a spray adhesive between the elastic web and second web adhesively securing the elastic web and the second web together.

26. A personal care product comprising:

an elastic laminate structure wherein the elastic laminate structure comprises:

(a) an elastic web consisting of a triblock copolymer and greater than 0% and less than about 50% by weight of a polyolefin wax, wherein the triblock copolymer comprises a block copolymer selected from the group consisting of a polystyrene/poly(ethylene-propylene)/polystyrene block copolymer and a polystyrene/poly(ethylene-butylene)/polystyrene block;

(b) a second nonwoven web comprising polyolefin fibers, wherein the polyolefin fibers and the polyolefin wax comprise the same polyolefin; and (c) a spray adhesive between the elastic web and second web adhesively securing the elastic web and the second web together.

27. The personal care product of claim 26, wherein the second web comprises a meltblown or spunbond nonwoven web comprising polyolefin fibers selected from the group consisting of polyethylene fibers, polypropylene fibers, and mixtures thereof.

28. The personal care product of claim 26, wherein the elastic laminate structure is a stretch-bonded laminate.

29. The personal care product of claim 26, wherein the elastic web comprises filaments.

30. The personal care product of claim 26, wherein the elastic laminate structure is a neck-bonded laminate.

31. The personal care product of claim 26, wherein the elastic web comprises a meltblown web, a spunbond web, or a film.

32. The personal care product of claim 26, wherein the laminate structure comprises at least one additional layer.

33. The personal care product of claim 26, wherein the personal care product is a disposable garment.

34. The personal care product of claim 26, wherein the disposable garment is selected from the group consisting of an incontinence garment, a disposable diaper, and disposable training pants.

35. The personal care product of claim 26, wherein the personal care product comprises a protective cover.

36. The personal care product of claim 26, wherein the personal care product is a feminine hygiene pad.

37. The personal care product of claim 26, wherein the personal care product is an incontinence control pad.

* * * * *